US009739060B2

(12) United States Patent
Beals

(10) Patent No.: US 9,739,060 B2
(45) **Date of Patent: *Aug. 22, 2017**

(54) INSULATION SYSTEM FOR A PRE-ENGINEERED METAL BUILDING

(71) Applicant: Therm-All, Inc., North Olmsted, OH (US)

(72) Inventor: William D. Beals, Winslow, ME (US)

(73) Assignee: THERM-ALL, INC, North Olmsted, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/045,756

(22) Filed: Feb. 17, 2016

(65) Prior Publication Data

US 2016/0160503 A1 Jun. 9, 2016

Related U.S. Application Data

(63) Continuation-in-part of application No. 14/338,470, filed on Jul. 23, 2014, now Pat. No. 9,290,930.

(60) Provisional application No. 61/880,575, filed on Sep. 20, 2013.

(51) Int. Cl.

| | |
|---|---|
| ***E04B 2/00*** | (2006.01) |
| ***E04C 2/34*** | (2006.01) |
| ***E04C 2/284*** | (2006.01) |
| ***E04C 2/08*** | (2006.01) |
| ***E04B 1/24*** | (2006.01) |

(Continued)

(52) U.S. Cl.

CPC ..... *E04C 2/46* (2013.01); *E04B 1/24* (2013.01); *E04C 2/08* (2013.01); *E04C 2/284* (2013.01); *E04C 2/34* (2013.01); *E04D 3/3603* (2013.01); *E04D 13/1618* (2013.01); *E04D 13/1625* (2013.01); *E04B 2001/2481* (2013.01); *E04B 2001/2487* (2013.01)

(58) Field of Classification Search

CPC . E04B 1/665; E04B 7/00; E04D 13/00; E04D 3/351; E04D 5/142; E04D 5/144

USPC ..... 52/407.3, 404.1, 407.5, 406.1

See application file for complete search history.

(56) References Cited

U.S. PATENT DOCUMENTS

| | | | |
|---|---|---|---|
| 3,307,306 | A | 3/1967 | Oliver |
| 4,014,150 | A | 3/1977 | Wells et al. |

(Continued)

FOREIGN PATENT DOCUMENTS

| | | |
|---|---|---|
| WO | 2011075541 | 6/2011 |

OTHER PUBLICATIONS

International Search Report and Written Opinion dated Nov. 19, 2014 for corresponding patent application No. PCT/US2014/047779.

(Continued)

*Primary Examiner* — Paola Agudelo

(74) *Attorney, Agent, or Firm* — Wegman, Hessler & Vanderburg

(57) ABSTRACT

A pre-engineered metal building configured to reduce air leakage through the shell of the building by providing an insulation system for fully sealing an enclosed space within the structural frame of the building. The insulation system includes a vapor barrier that defines the enclosed space, at least one insulation layer, and a continuous air barrier. Roof sheeting and side wall facing are attachable to the structural frame to form a shell about the building, and at least a portion of the insulation system is positioned between the shell and the structural frame.

13 Claims, 16 Drawing Sheets

(51) Int. Cl.
*E04D 3/36* (2006.01)
*E04D 13/16* (2006.01)

(56) References Cited

U.S. PATENT DOCUMENTS 4,446,664 A * 5/1984 Harkins ..... E04D 12/00 52/404.3
4,472,920 A * 9/1984 Simpson ..... E04B 1/14 52/222
4,573,298 A * 3/1986 Harkins ..... E04D 12/00 52/404.3
5,761,864 A 6/1998 Nonoshita
5,826,388 A 10/1998 Irving
5,953,883 A 9/1999 Ojala
6,216,416 B1 4/2001 West et al.
6,279,284 B1 8/2001 Moras
7,490,444 B2 * 2/2009 Nowack ..... E04C 2/292 428/221
8,181,410 B2 5/2012 Stensrud
8,209,915 B2 7/2012 O'Leary et al.
8,371,083 B2 2/2013 Chamberlin et al.
8,387,336 B2 * 3/2013 Coulton ..... E04B 1/625 52/409
8,438,810 B2 5/2013 Robbins et al.
8,844,230 B2 9/2014 Harkins
2005/0214496 A1 * 9/2005 Borenstein ..... B32B 7/02 428/40.1
2010/0146874 A1 6/2010 Brown
2011/0173913 A1 7/2011 Bodsford
2011/0197530 A1 * 8/2011 Bahnmiller ..... B32B 5/14 52/309.4
2011/0296778 A1 12/2011 Collins et al.
2012/0231231 A1 * 9/2012 Curtin ..... E04C 2/292 428/192
2013/0067841 A1 * 3/2013 Grieco ..... E04C 2/243 52/309.4
2014/0345223 A1 * 11/2014 Miks ..... E04C 2/46 52/309.4

OTHER PUBLICATIONS

"Air Barriers: Increasing Building Performance, Decreasing Energy Costs"; DuPont Tyvek; Architectural Record; Jan. 2006.
"New Construction Insulation"; Steel Building Insulation; Mar. 15, 2012.
"SealedNSafe"; suspended system.mov; Youtube.com; Feb. 15, 2011.
Lstiburek, J.; "Understanding Vapor Barriers"; Building Science Digest 106; Oct. 24, 2006.
"Install HomeWrap Over Rigid Foam Board and Window"; DuPont Tyvek; DuPontWeatherization; Youtube.com; Apr. 9, 2013.

* cited by examiner

INSULATION SYSTEM FOR A PRE-ENGINEERED METAL BUILDING

CROSS-REFERENCE TO RELATED APPLICATIONS

The present application is a continuation-in-part of U.S. patent application Ser. No. 14/338,470, filed on Jul. 23, 2014, which claims the benefit of U.S. Provisional Patent Application No. 61/880,575 filed on Sep. 20, 2013, which are both hereby incorporated by reference in its entirety.

FIELD OF THE INVENTION

The present invention is directed to an insulation system within a pre-engineered metal building, and more particularly, to a continuous air barrier that is combined with at least one layer of insulation having a vapor barrier forming an envelope about the enclosed space of a pre-engineered metal building.

BACKGROUND OF THE INVENTION

Pre-engineered metal buildings have long been used for various types of structures, including, but not limited to, commercial building spaces such as warehouses, garages, auto-body shops, community centers, storage facilities, and more. Pre-engineered metal buildings typically require less labor and materials to produce, thereby reducing the costs with respect to typical residential or commercial buildings that utilize brick-and-mortar and/or wood framing. Often, entire sections of the pre-engineered metal building can be constructed off-site then shipped to the building site and installed or otherwise assembled with very few steps required.

One problem often associated with pre-engineered metal buildings is that metal sheeting on the outside walls and the roof of pre-engineered metal buildings allows water vapor to permeate therethrough and into the interior of the building or into the fiberglass layer on the inside of the metal sheeting. When water vapor is trapped in the fiberglass, or insulating layer, the thermal transfer through the insulation layer between the inside of the building and the outside of the building increases dramatically.

The principle function of a vapor barrier is to stop or retard the passage of moisture (water vapor) as it diffuses through materials. A vapor barrier or retarder is a material that offers more resistance to the diffusion of water vapor than most materials. The moisture diffusion control property of a material is called its "water vapor permeance" which provides a "perm rating," as it is commonly referred to in the industry. A material typically needs to have a perm rating of less than 1.0 to be considered a vapor retarder. Most of the facing materials, such as the metal sheeting, used with fiberglass insulation in the pre-engineered metal building industry, have a perm rating of about 0.02.

Typical pre-engineered metal buildings currently utilize a layer of insulation having a vapor barrier, wherein the vapor barrier is inward-facing and the insulation is positioned against the inner surface of the outer metal sheeting of the building between the metal sheeting and the vapor barrier. This vapor barrier is often punctured, pierced, or the overall integrity is otherwise compromised during construction with the installation of doors, windows, HVAC systems, electrical systems, sprinkler systems, and the like are attached to the building framework.

BRIEF SUMMARY OF THE INVENTION

A need therefore exists to reduce air movement through or into the insulation layer positioned between the external metal sheeting and the inward-facing vapor barrier, particularly during cold weather, through any punctures in the vapor barrier.

In one aspect of the present invention, a pre-engineered metal building is provided. The pre-engineered metal building includes a structural frame attached to a foundation. The building further includes an insulation system attached to the structural frame to define an enclosed space between the insulation system and the foundation. The insulation system includes a vapor barrier having an inwardly-facing surface and an outwardly-facing surface. The vapor barrier surrounds the enclosed space, and the inwardly-facing surface is directed toward the enclosed space. The insulation system further includes at least one insulation layer positioned adjacent to the vapor barrier and a continuous air barrier. The continuous air barrier is positioned outwardly relative to an innermost layer of said at least one insulation layer. The continuous air barrier provides a fully sealed enclosed space. The building also includes a plurality of panels of side wall facing attached to the structural frame, wherein at least a portion of the insulation system is positioned between the plurality of panels of side wall facing and the structural frame. Finally, the building includes a plurality of panels of roof sheeting attached to the structural frame, wherein at least a portion of the insulation system is positioned between the plurality of panels of roof sheeting and the structural frame.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
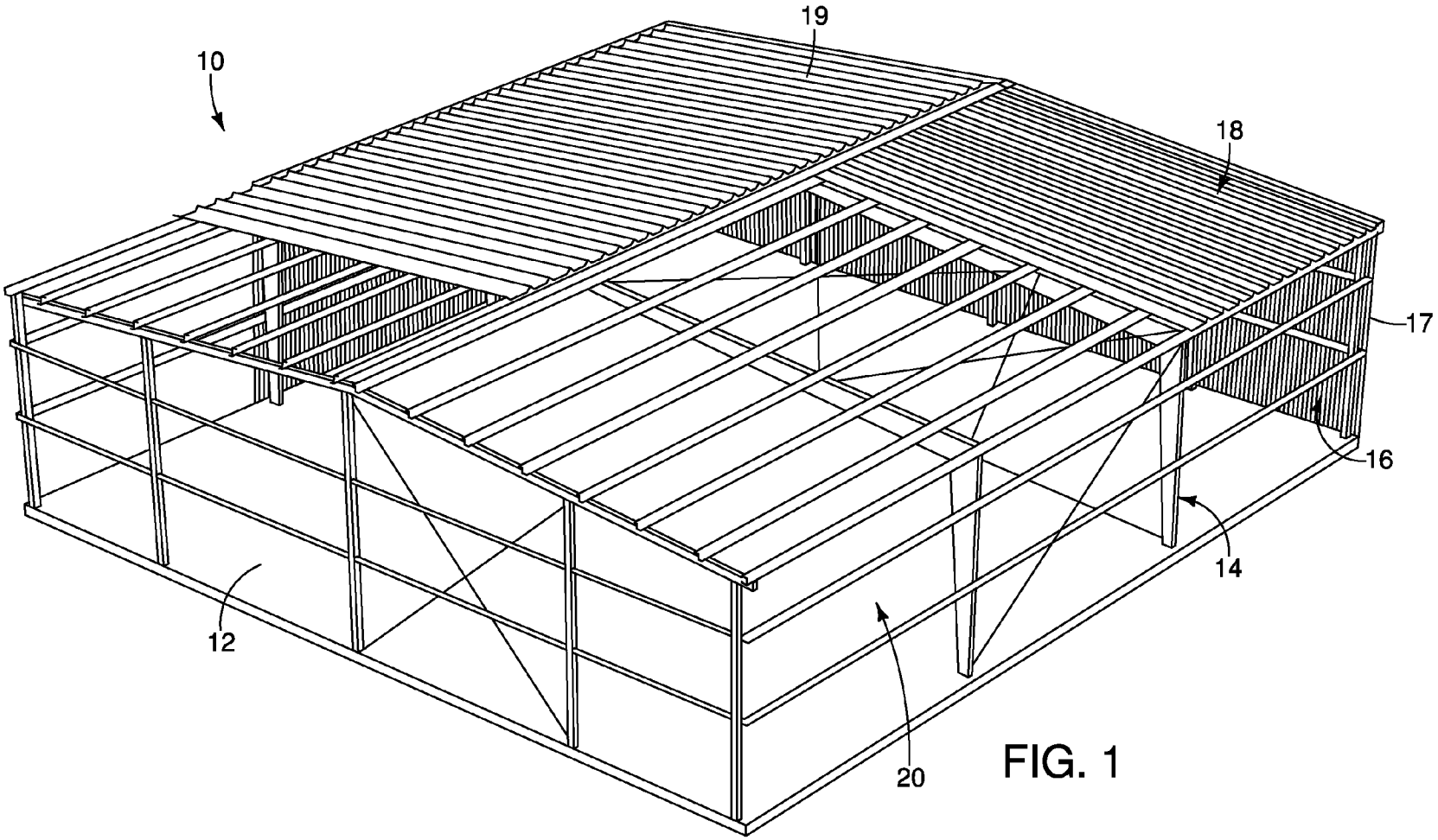
FIG. 1 is a perspective view of exemplary embodiment of a portion of a pre-engineered metal building.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Pre-engineered metal buildings are a type of building in which the dimensions and structure are pre-designed such that each building from a particular manufacturer or builder is substantially the same so that the structural components can be pre-fabricated in larger quantities due to the components having the same size/shape for each building. Although the pre-engineered metal buildings may have different dimensions customized to each buyer, having one set (or a small set) of designs and layouts allows a manufacturer/builder to maximize the usage of materials with little or no scraps remaining. Pre-engineered metal buildings are different than typical residential and/or commercial buildings because the pre-engineered metal buildings include materials and construction techniques that are incompatible or otherwise less desirable with typical residential and commercial buildings.

Water vapor diffusion is only one of the mechanisms by which water vapor can be transported into a wall or roof cavity. The other mechanism is by way of air leakage though the building materials. One function of the air barrier is to stop ambient air from entering the building as well as to stop air within the enclosed space to exfiltrate through the building envelope to the ambient environment. Air leakage is caused by air pressure differences in at least one of three forms: (1) the stack effect, which is dependent upon the temperature difference between the air within the enclosed space and the ambient air surrounding the building; (2) a pressure difference may induce air flow through the building materials caused by wind forces acting on the building; and (3) the operation of ventilation equipment may produce a pressure differential between the enclosed space and the ambient environment surrounding the building.

The American Society of Heating, Refrigeration, and Air-Conditioning Engineers (ASHRAE) standard 5.4.3.1 requires that the entire building envelope shall be designed and constructed with a continuous air barrier. The standard also requires that the air barrier be clearly identified or otherwise noted on the construction documents. In order to satisfy the requirement for an air barrier, the designer or builder can choose one of three methods: (1) whole house testing, (2) identification or designation of a material that acts as the air barrier, or (3) an assembly test. For the whole house testing, the entire assembled structure is tested to determine if the construction satisfies the requirements for air leakage. For the indication of material, the air barrier material is subjected to a box test to determine if the material satisfies the air permeance requirements. For the assembly test, a cross-section of the entire wall section (or ceiling section) is tested to determine if the assembly satisfies the requirements for air leakage. In an example, a vapor barrier can be identified or designated as the air barrier, so long as the material from which the vapor barrier is formed satisfies the permeance requirements of an air barrier material.

Referring to FIG. 1, an exemplary embodiment of a pre-engineered metal building 10 attached to a foundation 12 is shown. The building 10 includes a structural frame 14, panels of side wall facing 16 attached to the structural frame 14 to form the side walls 17 and part of the outer shell, and panels of roof sheeting 18 attached to the structural frame 14 to form the roof 19 and more of the outer shell. The side walls 17 and roof 19 in conjunction with the foundation 12 define an enclosed space 20 therewithin. Pre-engineered metal buildings 10 are often used for businesses, garages, storage facilities, auto-body shops, community centers, and other commercial uses. Particularly when the interior air quality or occupant comfort is important, pre-engineered metal buildings 10 are constructed with an insulation system positioned along all side walls 17 and roof 19 to form an envelope about the enclosed space 20, wherein insulation system effectively wraps the structural frame 14 to reduce or slow the flow of water vapor into the enclosed space 20 through the side wall facing 16 and roof sheeting 18. The envelope separates the conditioned space with the ambient environment surrounding the building.

Figure 2:
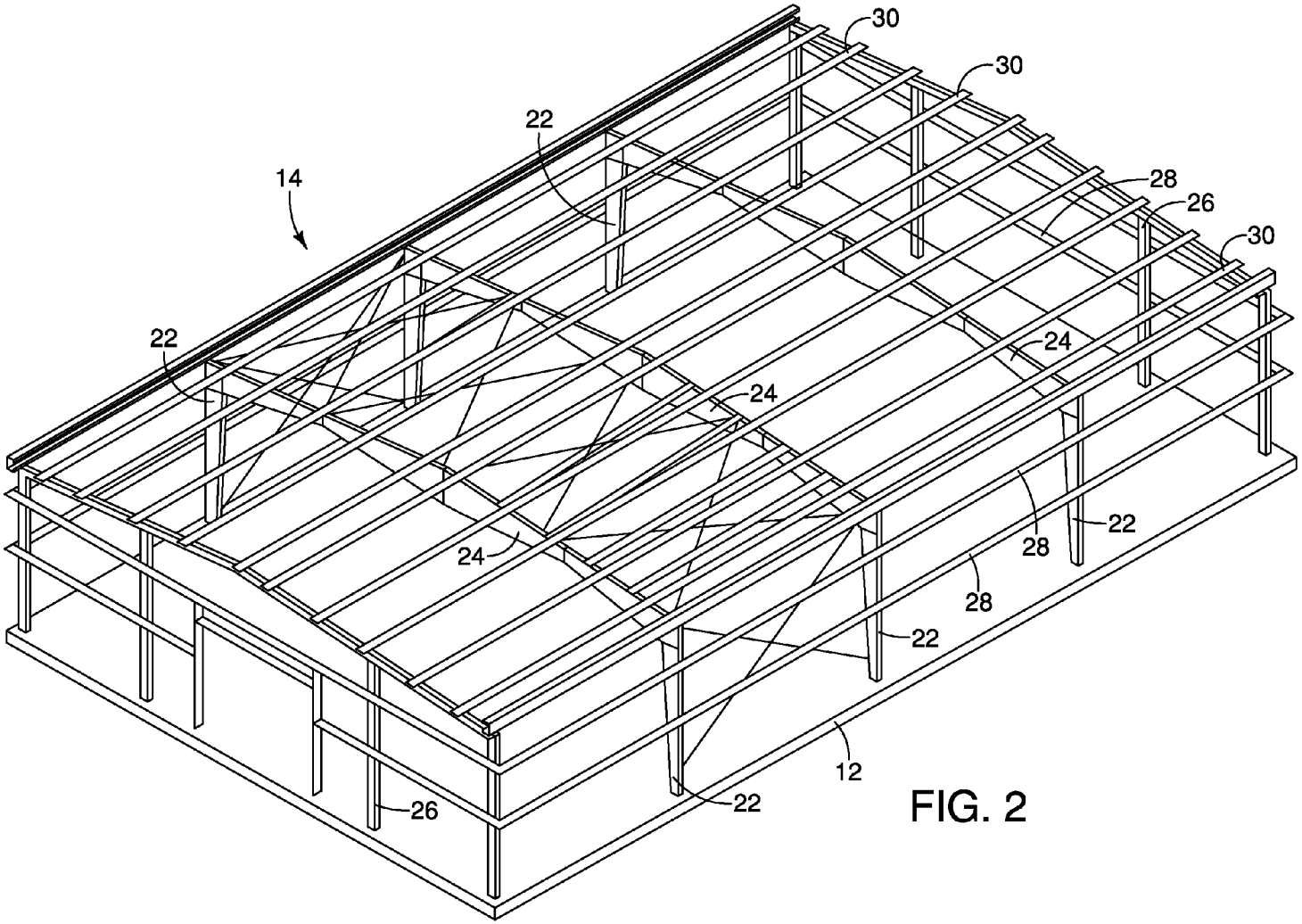
FIG. 2 is an embodiment of the structural frame of a pre-engineered metal building.

An exemplary embodiment of a structural frame 14 for a pre-engineered metal building 10 is shown in FIG. 2. The structural frame 14 includes a plurality of pairs of opposing, vertically oriented main frame columns 22, a main frame rafter 24 extending between each opposing pair of main frame columns 22, a plurality of vertically oriented secondary column 26, a plurality of substantially horizontally aligned girts 28 extending between columns 22, 26, and a plurality of purlins 30 extending between rafters 24. In the illustrated exemplary embodiment, the girts 28 are attached to the outwardly-directed surface of the columns 22, 26, and the purlins 30 are attached to the outwardly-directed surface of the rafters 24. In another embodiment, the girts 28 extend between the sides of the columns 22, 26, and the purlins 30 extend between the sides of the rafters 24. The structural frame 14 is fixedly attached to the foundation 12 to provide a solid base for the metal building 10 as well as aid in transferring loads from the structural frame 14 during various wind and environmental conditions. Each of the components of the structural frame 14 can be formed of the same material, or some components may be formed of on material and other components formed of other material(s). In an embodiment, the structural frame 14 is formed of steel. The columns 22, 26 and gifts 28 form the structural support for the side walls 17, and the rafters 24 and purlins 30 form the structural support for the roof 19.

Figure 3A:
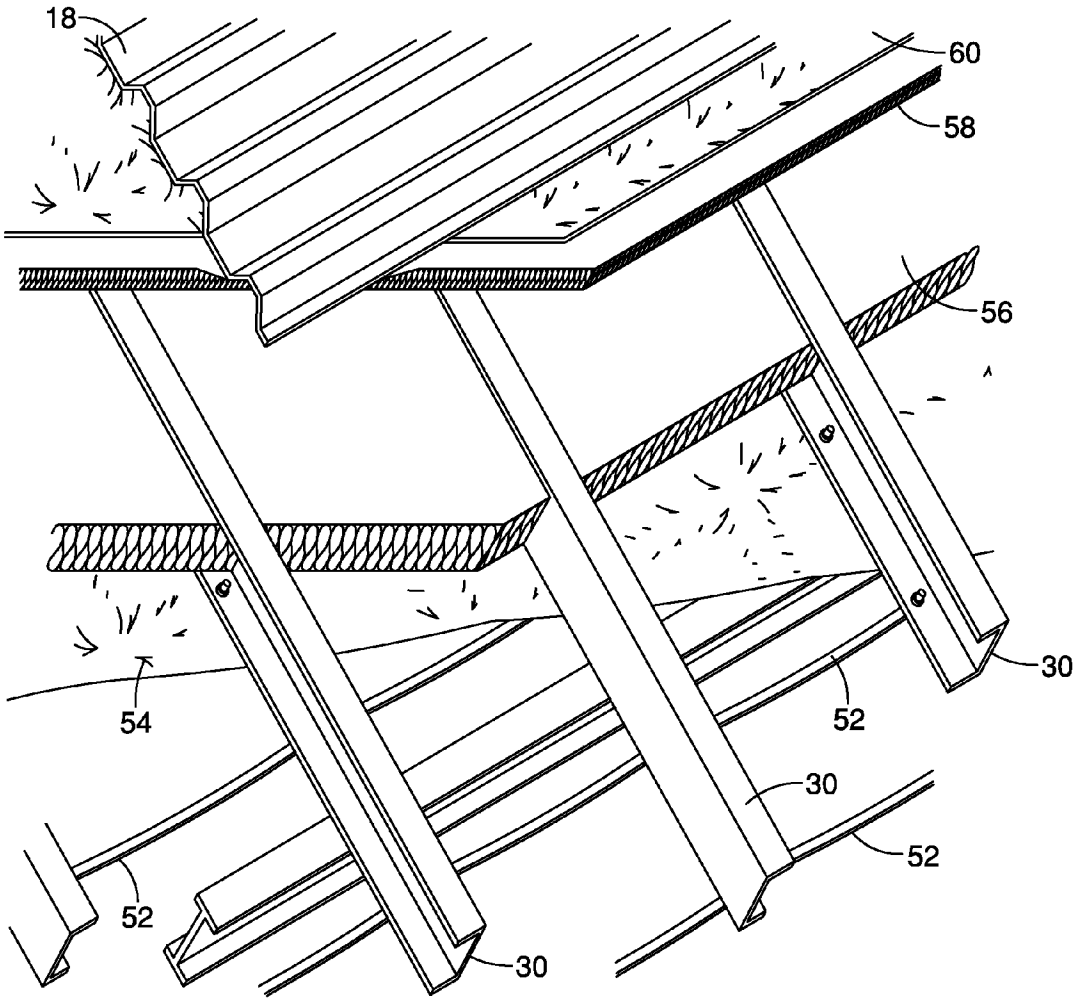
FIG. 3A is a sectional view of an embodiment of a portion of an insulation system.
Figure 3B:
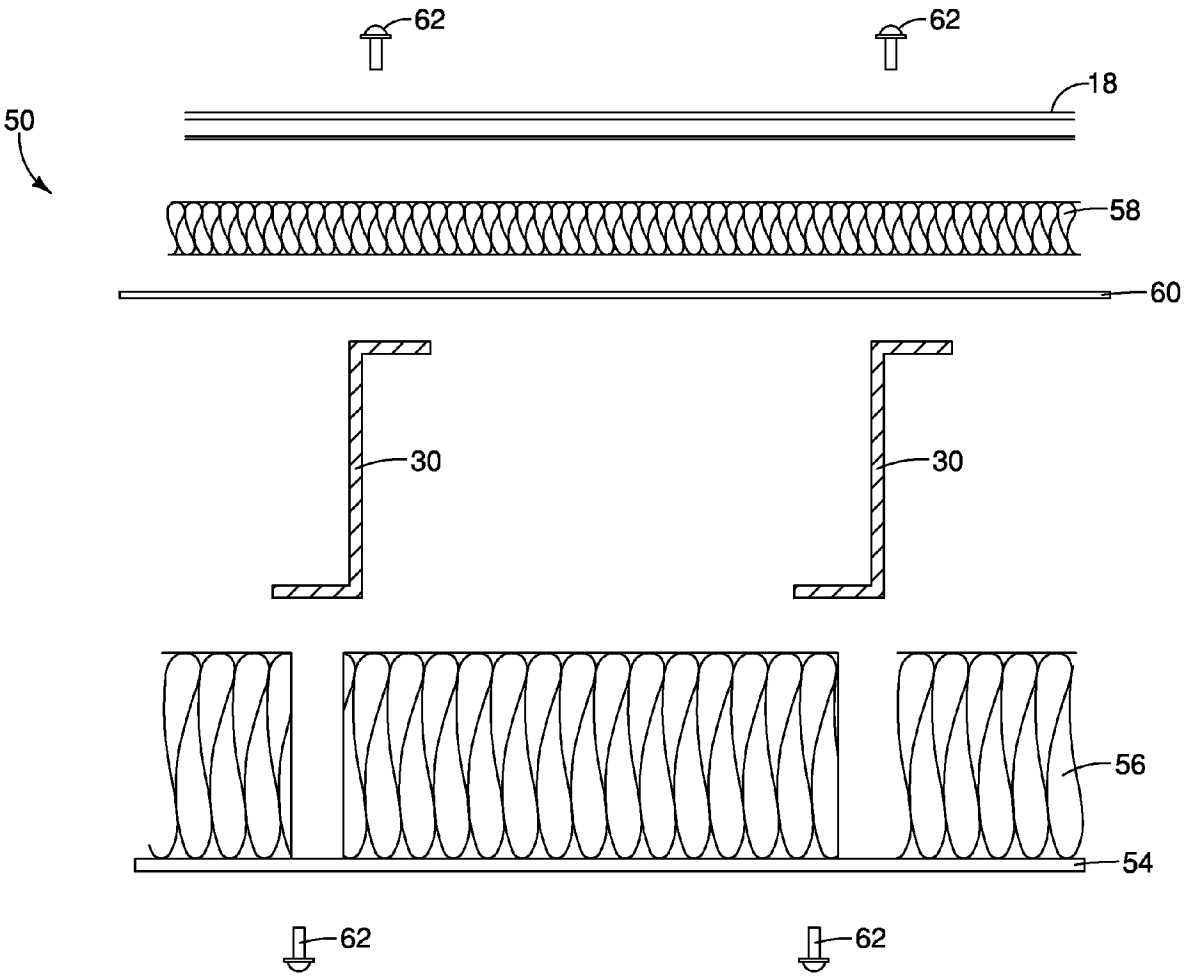
FIG. 3B is an exploded view of another embodiment of a portion of an insulation system.

The pre-engineered metal building 10 also includes an insulation system 50, portions of exemplary embodiments of which are shown in FIGS. 3A-3B, operatively connected to the structural frame 14 and which is sealingly connected to the foundation 12 to form a fully sealed envelope about the enclosed space 20. The insulation system 50 is incorporated with the structural components of the side walls 17 and the roof 19 to provide a combination of both a vapor barrier and an air barrier between the side wall facing 16, the roof sheeting 18, and the enclosed space 20. In an embodiment, the insulation system 50 includes a vapor barrier having an inwardly-directed surface directed inwardly toward the enclosed space, at least one insulation layer positioned adjacent to an outwardly-directed surface of the vapor barrier, and an air barrier positioned between the innermost of the insulation layers and the building shell (side wall facing 16 and roof sheeting 18. The insulation system 50 for a pre-engineered metal building 10 is configured to provide an envelope around the enclosed space 20 such that the envelope is fully sealed at the transitions between the roof 19 and the side walls 17 as wells as between the side walls 17 and the foundation 12. Although the insulation system 50 is configured to provide a completely or fully sealed enclosed space 20, it should be understood by one having ordinary skill in the art that the fully sealed enclosed space 20 may include at least one fenestration that is necessary to provide access to the enclosed space 20—such as doors and/or windows—or climate control features—such as HVAC systems or the like. While it is a goal to provide a fully sealed enclosed space 20 with the insulation system 50, slight air leakages as a result of installation or the result of degradation of materials over time are also encompassed within the meaning of a "fully sealed enclosed space."

FIG. 3A illustrates a portion of an embodiment of the insulation system 50 that is incorporated with the roof 19, wherein the insulation system 50 includes a plurality of bands 52 extending perpendicular to the purlins 30, a vapor barrier 54, a first insulation layer 56 oriented parallel to the purlins 30, a second insulation layer 58 oriented parallel to the rafters 24, and an air barrier 60. The outermost layer of the insulation system 50 is held in place by (or sandwiched between) the attachment of the roof sheeting 18 to the purlins 30 for the roof 19 and between the side wall facing 16 and the girts 28 of the side walls 17. FIG. 3B illustrates an exploded view of another embodiment of an insulation system 50 in which the vapor barrier 54 is fixedly attached to the first insulation layer 56, thereby eliminating the need for the bands 52. It should be understood by one skilled in the art that the vapor barrier 54 forms the innermost layer of the insulation system 50 that is directed toward the enclosed space 20, and the vapor barrier can be fixedly attached to a layer of insulation or may be installed separately from the next layer of insulation.

Figure 3C:
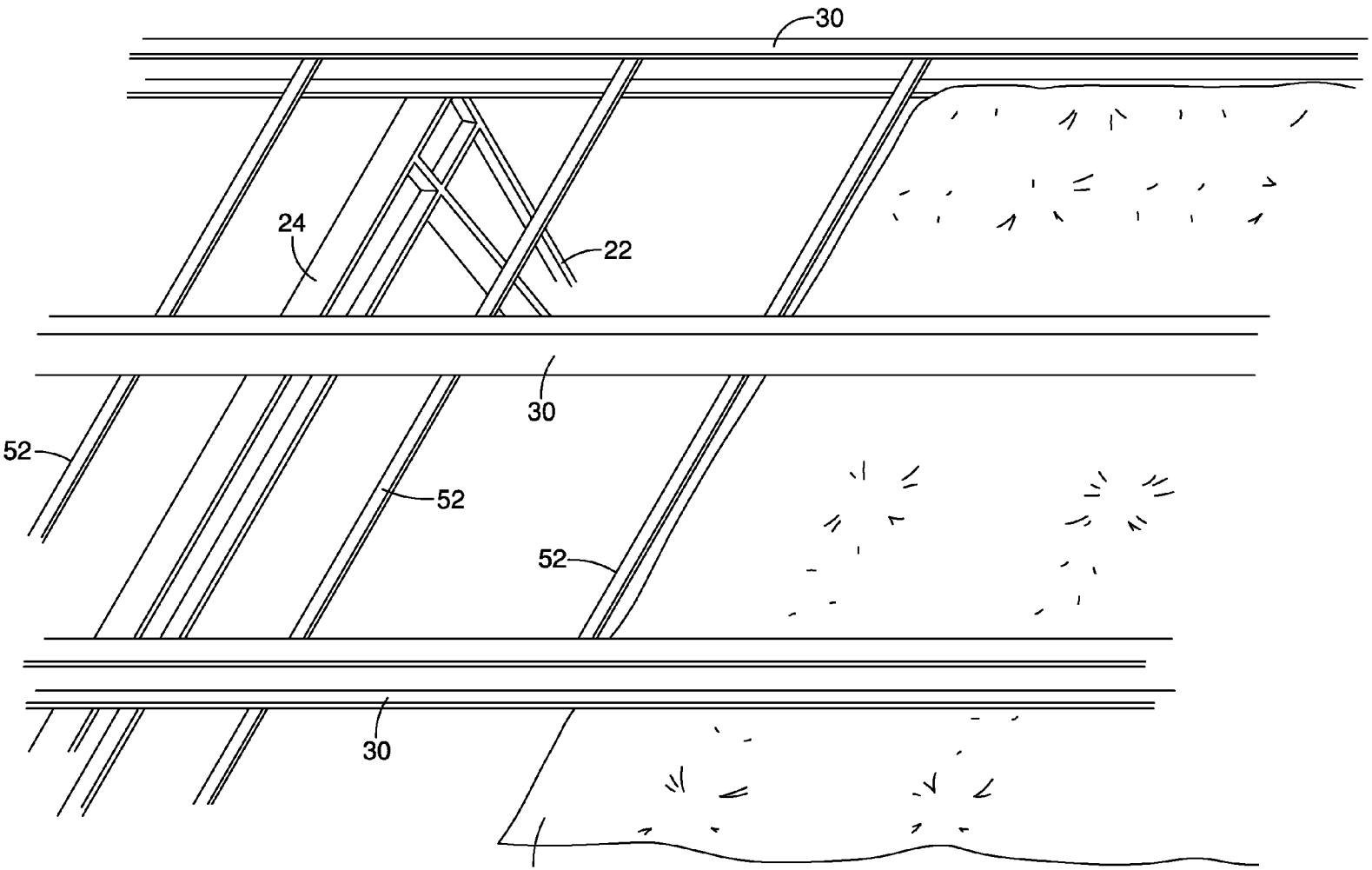
FIG. 3C is a perspective view of a portion of an insulation system.

The construction description provided herein will be in reference to the roof 19, but the same manner of construction of the insulation system 50 is used for the side walls 17. For example, reference to the purlins 30 of the roof 19 can be substituted with the girts 28 of the side walls 17, and reference to the roof sheeting 18 can be substituted for the side wall facing 16. When installing a portion of the insulation system 50 with the roof 19, the opposing ends of each band 52 is attached to the opposing eave struts at each end of the roof 19, wherein the bands 52 have some sag such that they are initially spaced-apart from the inwardly-directed surface of the purlins 30, as shown in FIG. 3C. The bands 52 are oriented substantially perpendicular relative to the purlins 30. A vapor barrier 54, formed as an elongated sheet, is then placed between the bands 52 and the purlins 30. The vapor barrier 54 can be formed as one continuous sheet that forms the entire inwardly-directed surface of the roof 19, or the vapor barrier 54 can be formed of multiple sheets in which adjacent sheets are integrally connected so as to form a continuous sheet to form the entire inwardly-directed surface of the roof 19. The vapor barrier 54 includes an inwardly-directed surface and an outwardly-directed surface, wherein the inwardly-directed surface is directed toward (and defines) the enclosed space 20 and the outwardly-directed surface is directed toward the ambient atmosphere surrounding the building. Once the vapor barrier 54 has been positioned between the bands 52 and the purlins 30, the bands 52 are then attached to each of the purlins 30 using mechanical fasteners 62 that provide a seal around the hole or puncture through the vapor barrier 54, such as a gasketed screw or the like. Once the bands 52 and vapor barrier 54 have been attached to the purlins 30, the inwardly-most surface of the insulation system 50 surrounding the enclose space 20 has been formed.

Once the vapor barrier 54 has been secured to the purlins 30 of the roof 19, a first insulation layer 56 is positioned parallel to the purlins 30 adjacent to the outwardly-directed surface of the vapor barrier 54, as shown in FIGS. 3A-3B. The first insulation layer 56 is configured to be positioned between adjacent purlins 30 in the roof 19, wherein the first insulation layer 56 ideally fills nearly the entire gap between adjacent purlins 30. In the embodiment shown in FIG. 3A, the first insulation layer 56 is an unfaced fiberglass layer; and in the embodiment shown in FIG. 3B, the first insulation layer 56 is an unfaced fiberglass layer in which the vapor barrier 54 is fixedly attached thereto. The vapor barrier 54 can be fixedly attached to the first insulation layer 56 by way of gluing, lamination, or any other method commonly known in the art. The first insulation layer 56 having the vapor barrier 54 fixedly attached thereto is often used in single-layer applications in which only one layer of insulation is used, but can also be used in multi-layer applications in which more than one layer of insulation is used.

In one embodiment, after positioning the first insulation layer 56 between adjacent purlins 30 in a parallel manner, an air barrier 60 is positioned between the first insulation layer 56 and the roof sheeting 18. Exemplary air barriers 60 may be Tyvek® Commercial Wrap® (produced by DuPont Building Innovations), GreenGuard RainDrop Building Wrap (produced by Pactive Building Products), or other similar materials. It should be understood by one having ordinary skill in the art that the exemplary air barriers are formed as mechanically fastenable commercial building wraps, but the air barrier can also be formed of a self-adhered sheet material, a fluid applied membrane, sprayed polyurethane foam, boardstock, or the like. Air barriers 60 and air barrier materials are typically defined as having an air permeance of less than 0.02 L/(s-m$^2$) therethrough. While the vapor barrier 52 of the insulation system 50 is configured to reduce or eliminate moisture migration between the ambient environment and the enclosed space 20, the air barrier 60 of the insulation system 50 is configured to reduce or eliminate air leakage between the ambient environment and the layer(s) of insulation between the outer shell of the building (roof sheeting and side wall facing) and the enclosed space 20. The air barrier is configured to be formed in sheets that are attachable and sealable to each other to form a single layer that covers the entire roof 19 and another single layer that covers the side walls 17, wherein the roof layer and the side wall layer(s) are attachable to each other and the foundation 12 to fully seal and envelope the enclosed space 20. Because the air barrier 60 is being used for a pre-engineered metal building 10, the dimensions of the layer for the roof and the side walls is pre-designed so that each subsequent building has the same size and shape of air barrier 60 for the roof and side walls, thereby making it easier to one seamless layer instead of using multiple sheets that are attached to each other to form each portion. Although having one single sheet or layer for the roof and each of the side walls reduces the overall installation time, it should be understood by one having ordinary skill in the art that each of the different portions of the air barrier 60 (roof and each side wall) can also be formed using a plurality of sheets that are fixedly and sealingly attached to each other to form a larger sheet for each respective portion.

In one embodiment of the insulation system 50, as shown in FIG. 3B, a second insulation layer 58 is positioned adjacent to the air barrier 60 outwardly relative to the vapor barrier 52 such that the second insulation layer 58 is positioned between the air barrier 60 and the roof sheeting 18. In another embodiment of the insulation system 50, as shown in FIG. 3A, a second insulation layer 58 is positioned adjacent to the air barrier 60 inwardly relative to the vapor barrier 52 such that the air barrier 60 is positioned between the second insulation layer 58 and the roof sheeting 18. While these examples are provided as exemplary embodiments, it should be understood that the air barrier 60 can be located at any position between the vapor barrier 54 and the roof sheeting 18. For example, the air barrier 60 can be located immediately adjacent to the roof sheeting 18 such that the installation of electrical lines, HVAC ducts, or the like, within the walls 17 or the roof 19 may require cutting through the vapor barrier 54 without the need for cutting through the air barrier 60. Alternatively, the air barrier 60 can also be located immediately adjacent to the purlins 30 allows the air barrier 60 to be more easily attached purlins 30 to create and maintain a seal between the air barrier 60 with support from the structural frame 14. Maintaining the integrity of the air barrier 60 maximizes the efficiency of the insulation system 50 by substantially reducing or eliminating the air leakage therethrough which would otherwise reduce the efficiency of the insulation system 50.

Figure 3D:
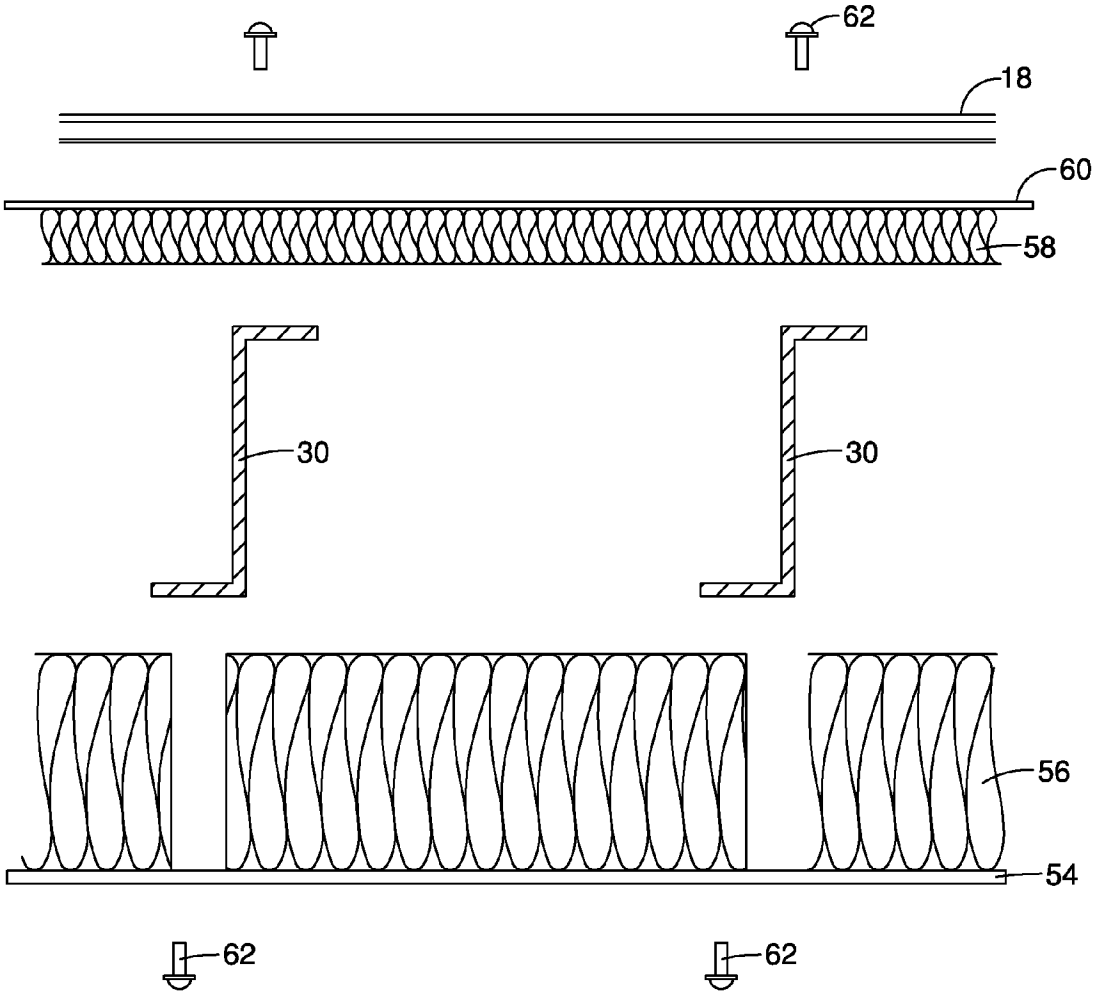
FIG. 3D is an exploded view of yet another embodiment of a portion of an insulation system.
Figure 3E:
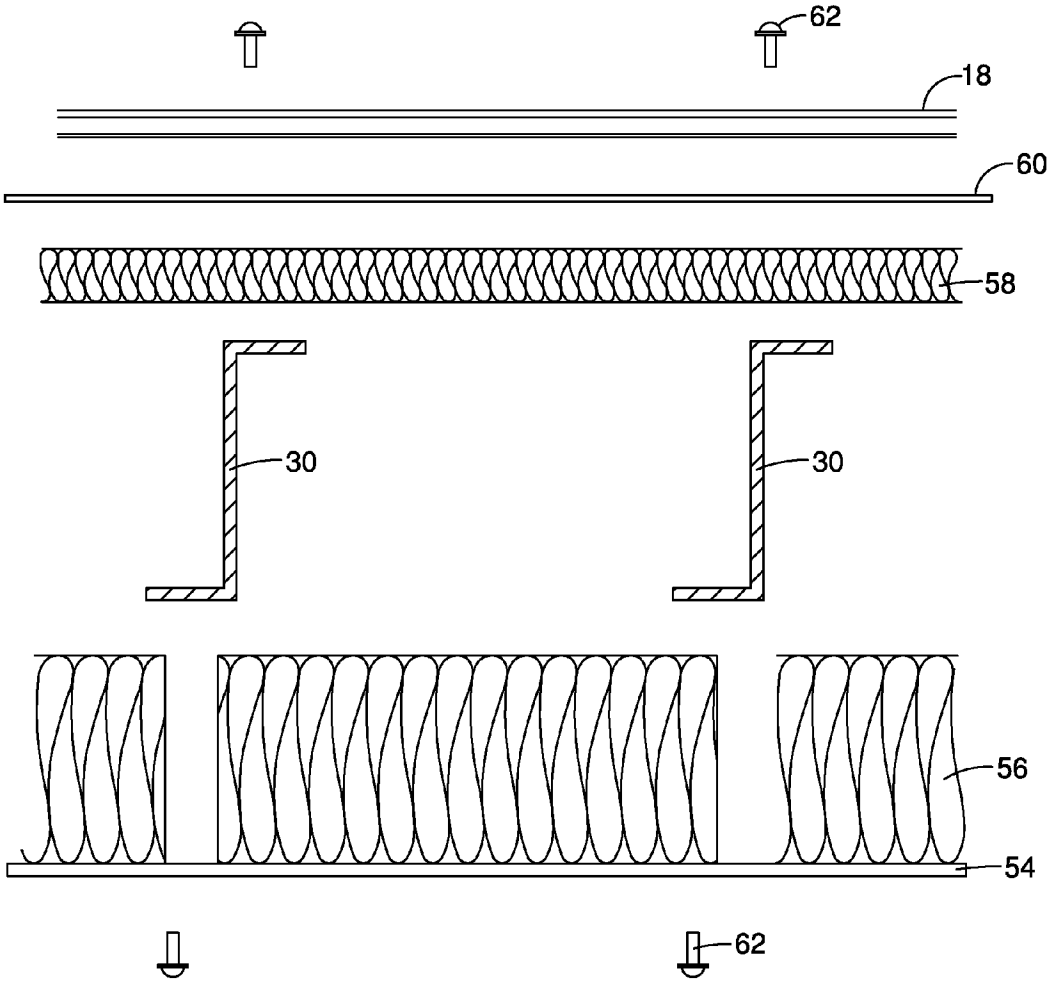
FIG. 3E is an exploded view of a further embodiment of a portion of an insulation system.
Figure 4A:
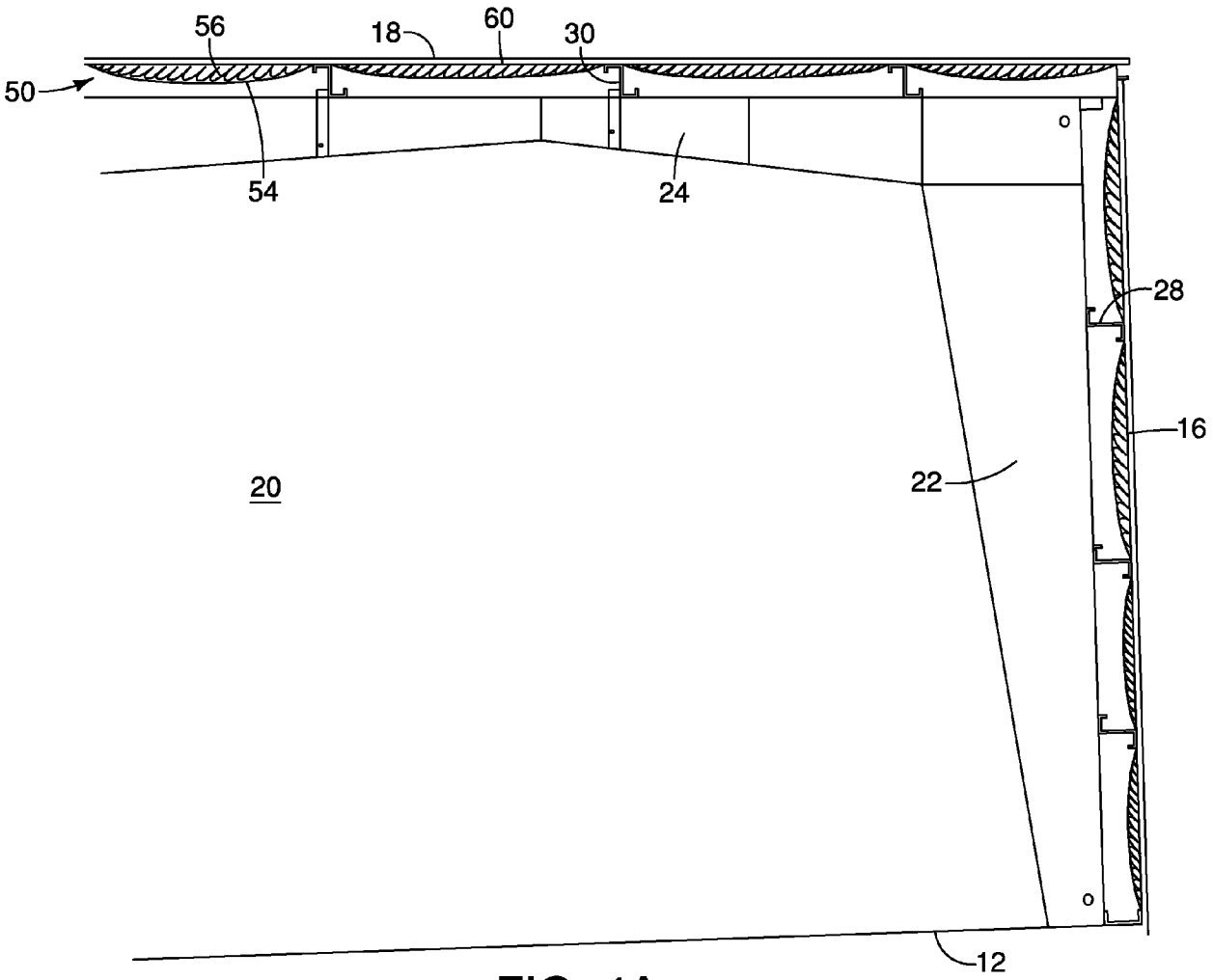
FIG. 4A is a sectional view of a portion of a pre-engineered metal building with an embodiment of an insulation system.
Figure 4B:
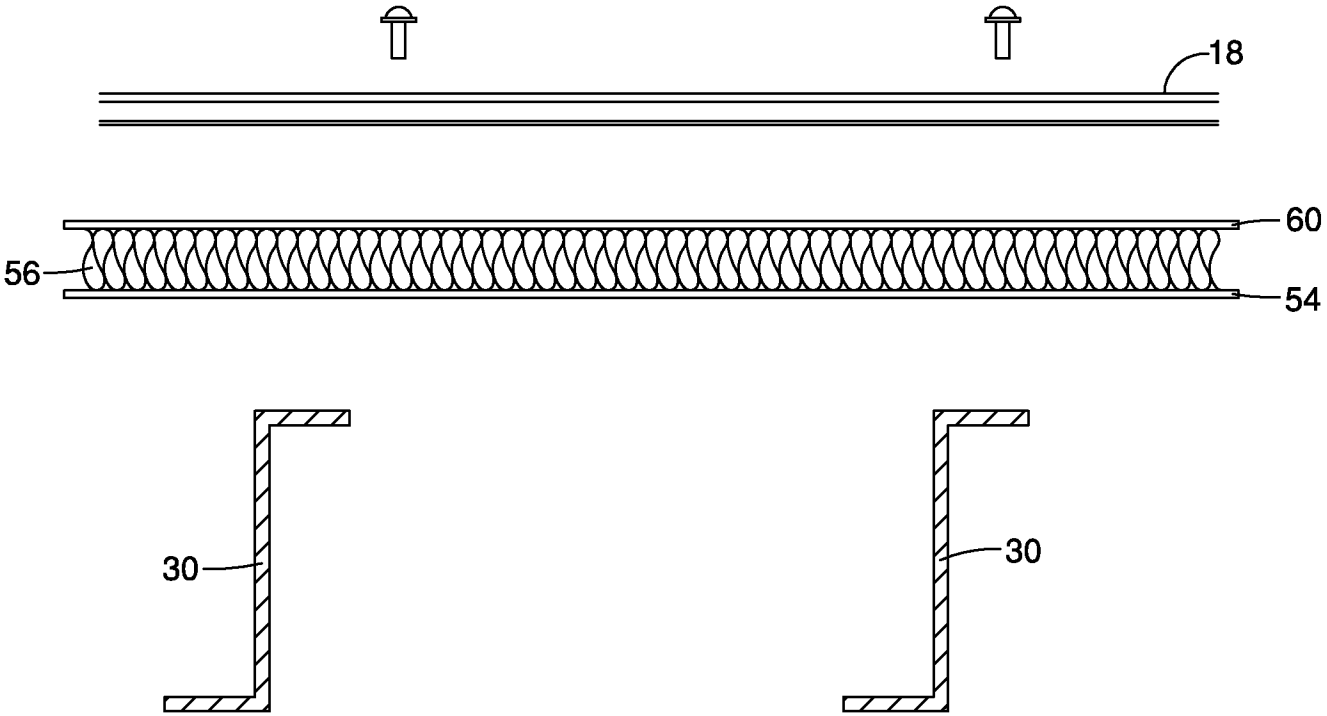
FIG. 4B is a cross-sectional view of the insulation system shown in FIG. 4A.

In an embodiment of the insulation system 50, as shown in FIGS. 3A and 3D, the air barrier 60 is fixedly attached to the second insulation layer 58. In another embodiment of the insulation system 50 shown in FIGS. 3B and 3E, the air barrier 60 is separate from the second insulation layer 58, but positioned immediately adjacent thereto in an abutting manner. The second insulation layer 58 is an unfaced layer of insulation, which can be formed of fiberglass, cotton, cellulose, or other similar material. In embodiments in which the air barrier 60 is fixedly attached to the second insulation layer 58, the air barrier 60 can be attached by gluing, laminating, or any other manner known in the art. The air barrier 60 attached to the second insulation layer 58 extends beyond at least one of the lateral (or long) edges of the second insulation layer 58 to form a flap, which is more easily sealingly attachable to the air barrier 60 attached to an adjacent second insulation layer 58. In a single-layer application, as shown in FIG. 4, in which only the first insulating layer 56 is used for the insulation system 50, the air barrier 60 is fixedly attached to the outwardly-directed surface of the first insulation layer 56 and the vapor barrier 54 is fixedly attached to the inwardly-directed surface of the first insulation layer 56. In another embodiment of a single-layer application, the air barrier 60 is positioned adjacent to the outwardly-directed surface of the first insulation layer 56 in an abutting relationship therewith and the vapor barrier 54 is fixedly attached to the inwardly-directed surface of the first insulation layer 56.

In one embodiment, the second insulation layer 58 is installed adjacent to the air barrier 60 when the air barrier 60 is positioned immediately adjacent to the purlins 30 (FIG. 3B). In another embodiment the second insulation layer 58 is installed adjacent to the purlins 30, after which the air barrier 60 is positioned adjacent to the outwardly directed surface of the second insulation layer 58 (FIG. 3A). Once the second insulation layer 58 and air barrier 60 are installed or otherwise positioned relative to the structural frame 14, the roof 19 portion of the insulation system 50 is integrated with the side wall portion(s) at the eave struts to form a continuous air barrier 60 about the entire enclosed space 20. The insulation system 50 is also integrated with the foundation 12 to ensure a proper seal between the insulation system and the foundation 12 in order to form a fully sealed enclosed space 20.

Once the insulation system 50 has been installed, the roof sheeting 18 and side wall facing 16 are positioned immediately adjacent to the outwardly-directed surface of the outermost layer of the insulation system 50. The roof sheeting 18 and side wall facing 16 are secured to the purlins 30 and girts, respectively, by attachment mechanisms 62, such as bolts or the like, wherein the attachment mechanisms 62 extend through both the second insulation layer 58 and the air barrier 60. The attachment mechanisms 62 are configured to maintain the integrity of the air barrier 60 by sealing the intrusion therethrough.

Figure 3F:
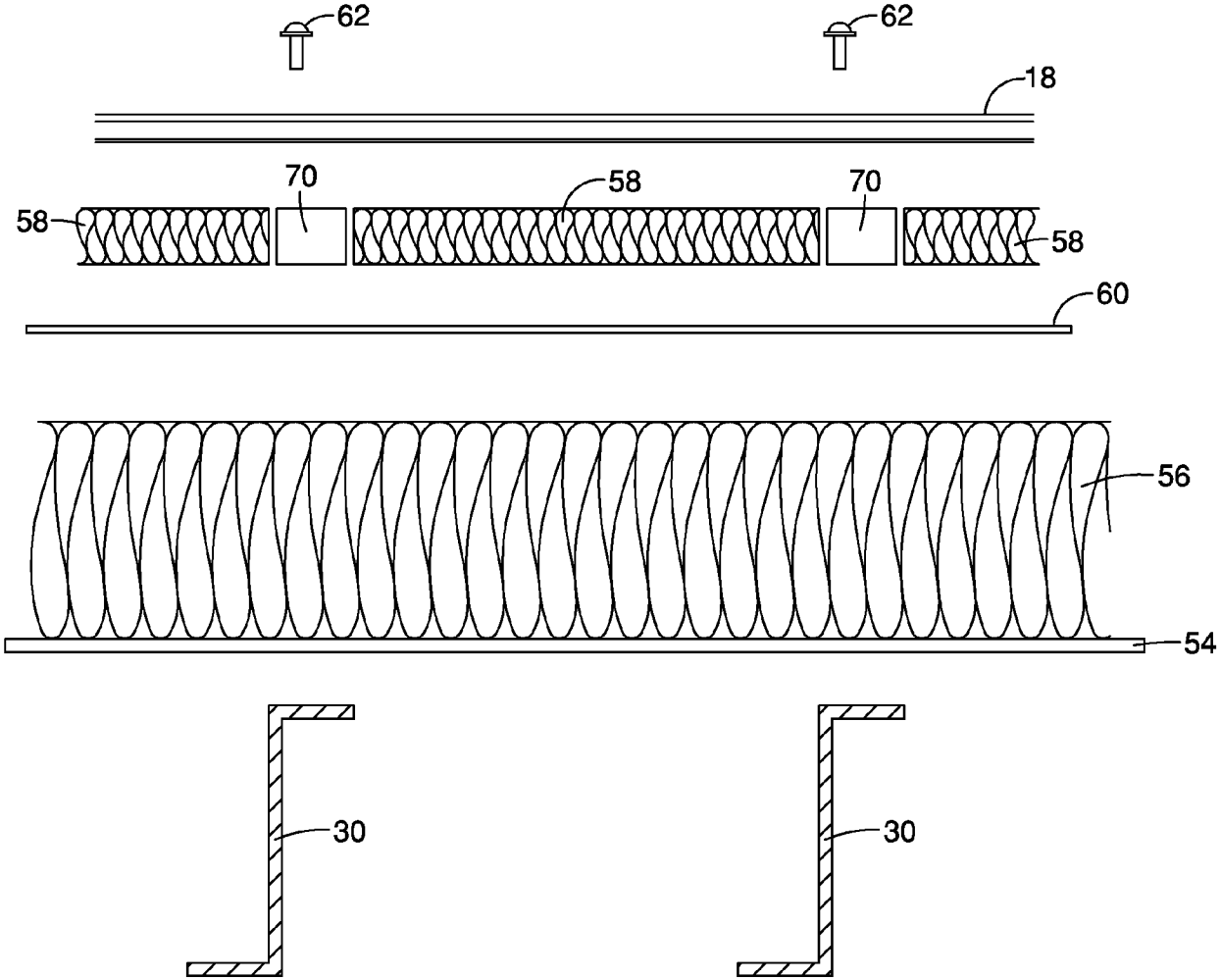
FIG. 3F is an exploded view of another embodiment of a portion of an insulation system.

In another exemplary embodiment of the insulation system 50, as shown in FIG. 3F, the vapor barrier 54 is fixedly attached to the first insulation layer 56, and the combined first insulation layer 56/vapor barrier 54 is positioned adjacent to the outwardly-directed surface of the purlins 30 in a perpendicular manner. A separate air barrier 60 is positioned adjacent to the unfaced surface of the first insulation layer 56 such that the air barrier 60 is positioned outwardly from the first insulation layer 56 relative to the purlins 30. The second insulation layer 56 is formed of rolls of unfaced insulation that are oriented parallel to the purlins 30 and positioned outwardly relative to the air barrier 60. Spacers 70 are positioned between adjacent rolls of the unfaced insulation of the second insulation layer 56 to minimize the gaps between adjacent rolls of unfaced insulation to prevent a loss of R-value of the insulation system 50. When the roof sheeting 18 is attached, the vapor barrier 54, first insulation layer 56, air barrier 60, and spacers 70 are sandwiched between the roof sheeting 18 and the purlins 30, and the second insulation layer 56 is sandwiched between the roof sheeting 18 and the air barrier 60. It should be understood by one having ordinary skill in the art that alternative embodiments of the insulation system 50 shown in FIG. 3F may have the air barrier 60 positioned between the second insulation layer 56/spacers 70 and the roof sheeting 18 or the air barrier 60 may be fixedly attached to the second insulation layer 56. This installation method is typically referred to as "sag and bag."

Figure 3G:
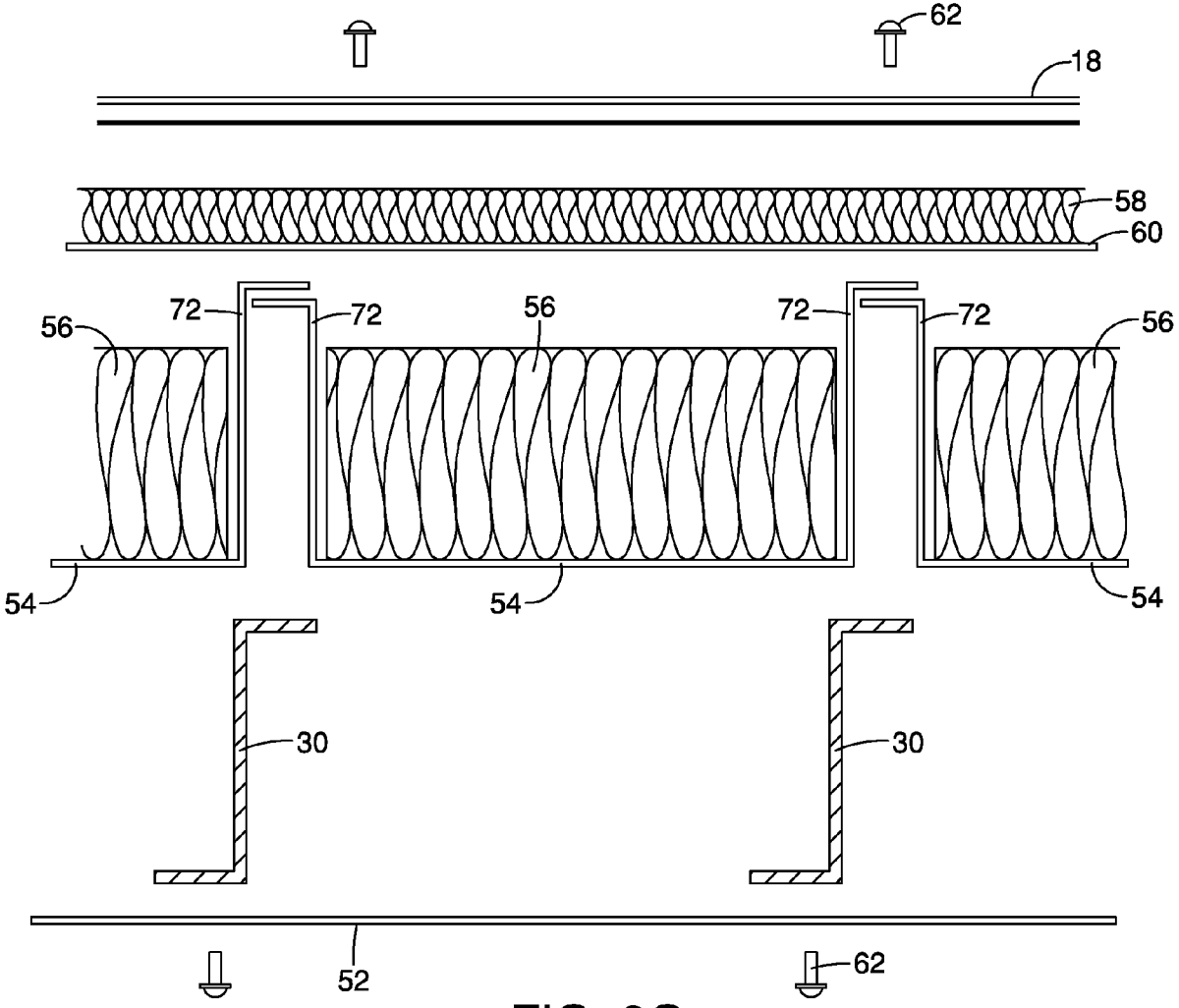
FIG. 3G is an exploded view of a further embodiment of a portion of an insulation system.

In yet another exemplary illustrated embodiment of the insulation system 50, as shown in FIG. 3G, the bands 52 described above are position adjacent to the inwardly-directed surface of the purlins 30. The vapor barrier 54 is fixedly attached to the first insulation layer 56, wherein the vapor barrier 54 extends beyond the lateral edges of the roll of insulation to which it is attached so as to form tabs 72. The tabs 72 extend from at least one lateral edge of the first insulation layer 56. The embodiment illustrated in FIG. 3G shows the vapor barrier 54 fixedly attached to the first insulation layer 56 and extending therefrom to form tabs 72 that extend from both lateral edges of the first insulation layer 56. The first insulation layer 56 having the vapor barrier 54 attached thereto and forming tabs 72 extending therefrom is positioned adjacent to the bands 52 and oriented parallel to the purlins 30 such that the tabs 72 extend over the outwardly directed surface of the purlins 30. Tabs 72 extending from adjacent rolls of the first insulation layer 56 are overlapped against the purlin 30. Each tab 72 extends laterally from the first insulation layer 56 between about four inches (4.0") to about eighteen inches (18.0"), but it should be understood by one having ordinary skill in the art that the length of the tabs 72 should be sufficient to ensure that the tabs 72 are able to extend parallel to the side edges of the first insulation layer 56 and still be able to cover a portion of the outwardly directed surface of the purlin 30 with enough length to overlap the tab 72 of the adjacent first insulation layer 56. The second insulation layer 58 having the air barrier 60 fixedly attached to the inwardly-directed surface thereof is positioned adjacent to the first insulation layer 56 in a perpendicular orientation such that the air barrier 60 contacts the unfaced surface of the first insulation layer 56 as well as directly contacts the overlapping tabs 72 of the vapor barrier 54. It should be understood by one having ordinary skill in the art that the insulation system 50 illustrated in FIG. 3G may include the air barrier 60 fixedly attached to the outwardly-directed surface of the second insulation layer 58 or positioned adjacent to either the inwardly-directed or outwardly-directed surface of the second insulation layer 58 in an abutting (non-fixedly attached) manner. The roof sheeting 18 is then positioned adjacent to the second insulation layer 58.

The fully sealed envelope about the enclosed space 20 of a pre-engineered metal building 20 has inherent weaknesses at the joints between the roof 19 and side walls 17 and between the side walls 17 and the foundation 12. It should be understood by one having ordinary skill in the art that the manner in which the air barrier 60 of the side walls 17 is attached and integrated with the air barrier 60 of the roof 19 and between the side walls 17 and the foundation 12 can be done in any manner that provides a continuous air barrier 60 which is formed to fully surround the enclosed space 20. The insulation systems 50 described above are configured to provide a continuous air barrier 60 about the enclosed space 20 in order to reduce or eliminate air leakage. The continuous air barrier 60 surrounding the enclosed space 20 of a pre-engineered metal building 10 provides a comfortable interior working/storage space, increased thermal efficiency, and energy savings. The continuous air barrier 60 also eliminates or reduces occupant discomfort as a result of drafts, degradation of the building materials due to moisture, poor indoor air quality due to ingress of fumes, dust, and the like, difficulties in balancing the HVAC system, noise travel through leakage paths, and microbial growth within building cavities.

The descriptions below refer to the member of the structural frame 14 forming the transition between the roof 19 and the side walls 17 as the eave strut 31, as shown in FIGS. 5B, 6B, 7B, 8B, and 9B, but it should be understood by one having ordinary skill in the art that adjacent members of the structural frame 14 forming the transition between the roof 19 and the side walls 17 are rake angles. However, for ease of reference and description, this member of the structural frame 14 forming such transition will simply be referred to as the eave strut 31 herein.

Figures 5A, 5B:
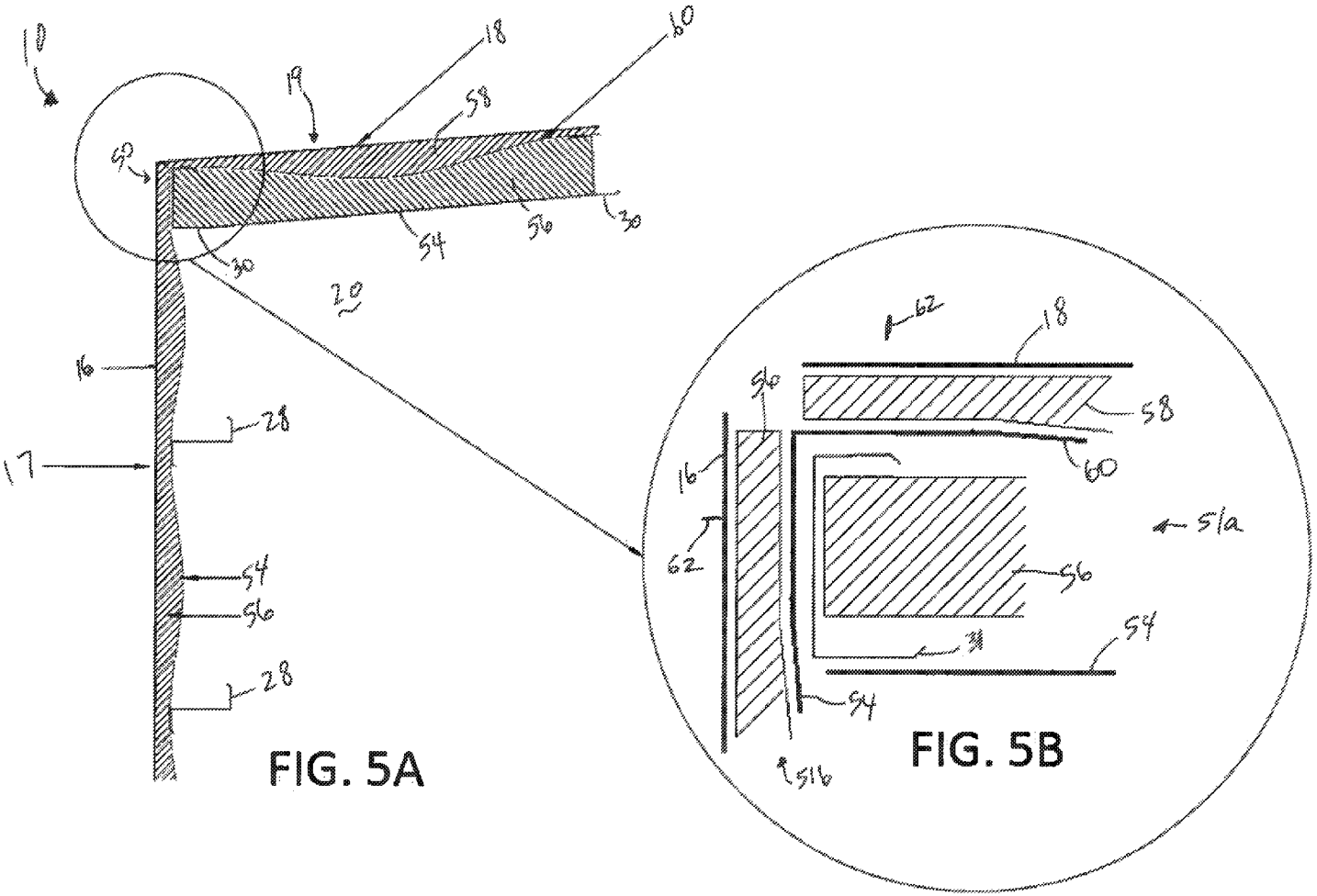
FIG. 5A is a cross-sectional view of another embodiment of a portion of an insulation system.
FIG. 5B is an exploded view of the insulation system shown in FIG. 5A.

In another embodiment of a pre-engineered metal building 10 shown in FIGS. 5A-5B, the insulation system 50 includes a first insulation assembly 51*a* for the roof 19 and a second insulation assembly 51*b* for the side walls 17, wherein the first insulation assembly 51*a* is different than the second insulation assembly 51*b*. The second insulation assembly 51*b* for the side walls 17 includes a single-layer insulation system, and the first insulation assembly 51*a* for the roof 19 includes a double-layer insulation system. The second insulation assembly 51*b* for the side walls 17 includes a vapor barrier 54 and a first insulation layer 56 positioned between the girts 28 and the side wall sheeting 16. The vapor barrier 54 is positioned adjacent to the outer surface of the girts 28. The first insulation layer 56 is positioned adjacent to the outwardly-directed surface of the vapor barrier 54. The side wall facing 16 is positioned outward of the first insulation layer 56 such that the first insulation layer 56 and the vapor barrier 54 are sandwiched between the side wall facing 16 and the girts 28. To satisfy the ASHRAE standard requiring an air barrier, the vapor barrier 54 of the second insulation assembly 51*b* for the side walls 17 is designated as the air barrier. In the illustrated embodiment, the material forming the vapor barrier 54 must meet the permeance requirements of an air barrier in order to be designated as the air barrier in the side walls 17.

The first insulation assembly 51*a* for the roof 19, as shown in FIGS. 5A-5B, includes a vapor barrier 54, a first insulation layer 56, an air barrier 60, and a second insulation layer 58 all positioned inward of roof sheeting 18. The vapor barrier 54 is similar to—or the same as—the vapor barrier 54 of the side walls 17. In an embodiment, the vapor barrier 54 is operatively connected to the purlins 30, and extends upwardly toward the roof-to-side wall transition adjacent to the eave struts 31 and rake angles (not shown). A first insulation layer 56 is positioned adjacent to the outwardly-directed surface of the vapor barrier 54, wherein the first insulation layer 56 is located between adjacent purlins 30. The air barrier 60 is then positioned adjacent to, and outward of, the first insulation layer 56. The air barrier 60 of the first insulation assembly 51*a* for the roof 19 is designated as the air barrier for the roof portion of the overall insulation system 50. The second insulation layer 58 is positioned adjacent to the outwardly-directed surface of the air barrier 60, wherein the air barrier 60 and the second insulation layer 58 are sandwiched between the roof panels 18 and the purlins 30 when the roof panels 18 are installed with the mechanical fasteners 62 (FIG. 5B). The mechanical fasteners 62 are inserted through the roof panels 18, second insulation layer 58, air barrier 60, and the purlins 30 (as well as the eave struts 31 and the rake angles) to provide a sealed connection between the components to prevent rain or liquid intrusion as well as prevent air or water vapor to escape through the hole created by the mechanical fasteners 62. It should be understood by one having ordinary skill in the art that the air barrier 60 of the first insulation assembly 51*a* extends across the top surface of the eave strut 31 and laps around the corner of the eave strut 31 such that the air barrier 60 extends at least partially along the lateral side edge of the eave strut 31. It should also be understood by one having ordinary skill in the art that although FIG. 5B shows only the air barrier 60 of the first insulation assembly 51*a* being attached to the vapor barrier 54 of the second insulation assembly 51*b* at the roof-to-side wall transition, the vapor barrier 54 of the first insulation assembly 51*a* may also be attached to the vapor barrier 54 of the second insulation assembly 51*b*. Additionally, although FIG. 5B shows the vapor barrier 54 of the second insulation assembly 51*b* being spaced apart and separated from the first insulation layer 56, other embodiments may include the vapor barrier 54 being attached to the first insulation layer 56 through lamination, gluing, or other similar manner.

In an embodiment, the air barrier 60 of the first insulation assembly 51*a* for the roof 19 is secured to the first insulation layer 56. In another embodiment, the air barrier 60 is formed as a continuous sheet—which can include attaching multiple smaller sheets of air barrier 60 material to form the continuous sheet—that is rolled or positioned over the first insulation layer 56 without being attached to either the first or second insulation layer 56, 58. In a further embodiment, the air barrier 60 is secured to the second insulation layer 58. The air barrier 60 can be attached to either the first or second insulation layer 56, 58 by way of lamination, gluing, co-extrusion, or any other manner of fixedly attaching the air barrier 60 to the insulation layer. The air barrier 60 of the first insulation assembly 51*a* for the roof 19 is formed as a continuous sheet or layer of material, wherein the layer can be a single piece of material or multiple pieces of material secured to each other in order to form the continuous layer. During installation, the air barrier 60 of the first insulation assembly 51*a* for the roof 19 is sealingly attached to the vapor barrier 54 of the second insulation assembly 51*b* for the side walls 17 at the roof-to-wall transition(s) at the eave strut 31, as shown in FIGS. 5A-5B. The vapor barrier 54 of the side walls 17 is sealingly attached to the portion of the air barrier 60 that extends around the corner of the eave strut 31 and extends adjacent to the vertical side-edge thereof in an overlapping connection. This connection between the air barrier 60 and the vapor barrier 54 forms a continuous air barrier 60 surrounding the interior of the building that is then attached to the foundation 12 to provide a fully sealed enclosed space 20.

Figures 6A, 6B:
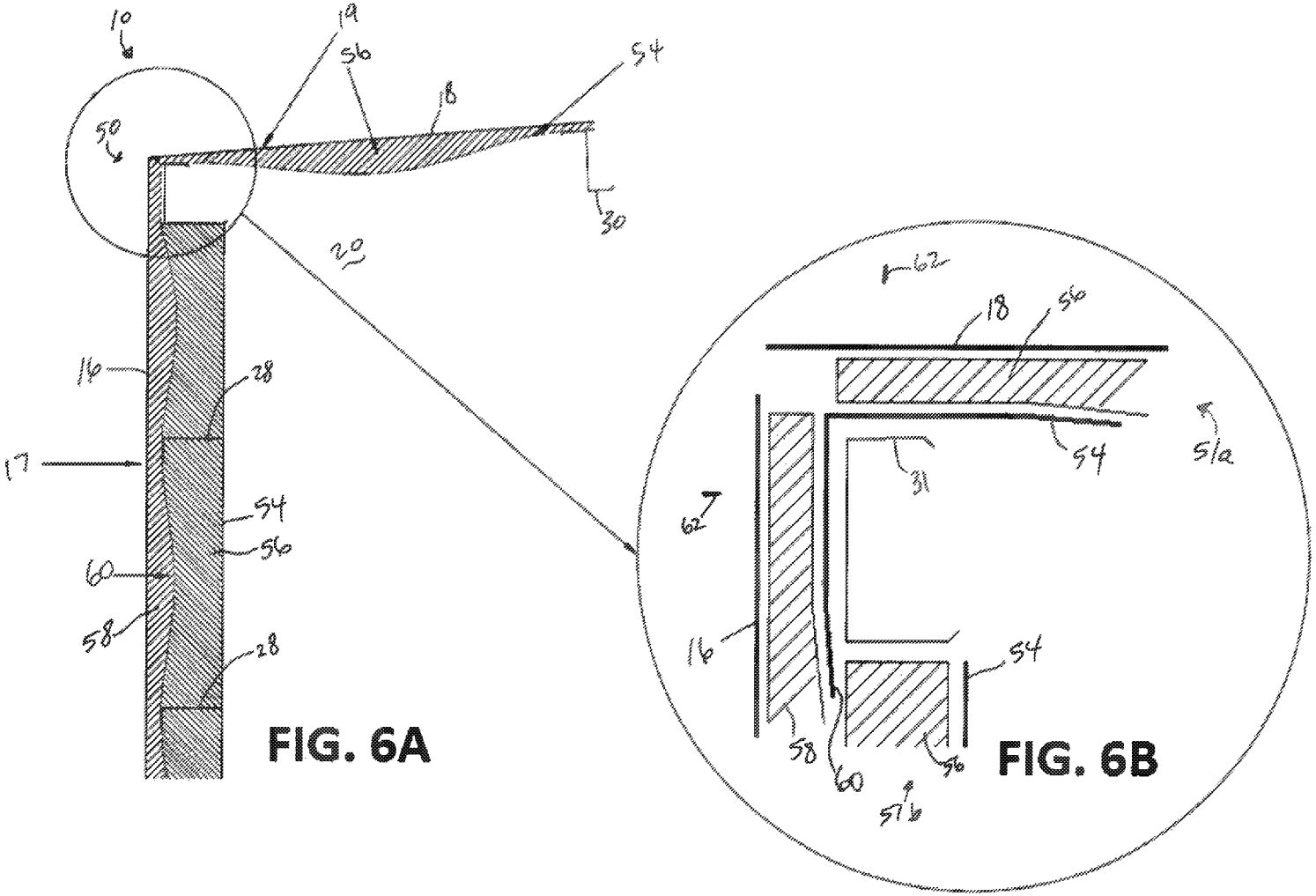
FIG. 6A is a cross-sectional view of yet another embodiment of a portion of an insulation system.
FIG. 6B is an exploded view of the insulation system shown in FIG. 6A.

FIGS. 6A-6B illustrate another embodiment of a pre-engineered metal building 10 in which the insulation system 50 includes at least a first insulation assembly 51*a* for the roof 19 and a second insulation assembly 51*b* for the side walls, wherein the first and second insulation assemblies 51*a*, 51*b* are different. The second insulation assembly 51*b* for the side walls 17 includes a double-layer insulation system, and the first insulation assembly 51*a* for the roof 19 includes a single-layer insulation system. The second insulation assembly 51*b* for the side walls 17 includes a vapor barrier 54, a first insulation layer 56, an air barrier 60, and a second insulation layer 68. The vapor barrier 54 is operatively connected to the inwardly-directed surface of the girts 28. A first insulation layer 56 is positioned adjacent to the outwardly-directed surface of the vapor barrier 54 and extends between the horizontally-aligned girts 28. An air barrier 60 is then positioned adjacent to, and outward of, the first insulation layer 56 and adjacent to the outwardly-directed surface of the girts 28. A second insulation layer 58 is positioned adjacent to the outwardly-directed surface of the air barrier 60, wherein the air barrier 60 and the second insulation layer 58 are sandwiched between the side wall facing 16 and the girts 28 when the sheets of side wall facing 16 are installed with the mechanical fasteners 62 (FIG. 6B). The mechanical fasteners 62 are inserted through the side wall facing 16, second insulation layer 58, air barrier 60, and the girts 28 to provide a sealed connection therebetween. To satisfy the ASHRAE standard requiring an air barrier, the air barrier 60 of the second insulation assembly 51*b* of the side walls 17 is designated as the air barrier within the side wall assembly. It should be understood by one having ordinary skill in the art that the air barrier 60 of the second insulation assembly 51*b* extends up the side surface of the eave strut 31 and laps around the corner of the eave strut 31 such that the air barrier 60 extends at least partially across the upper surface of the eave strut 31.

In an embodiment, the air barrier 60 of the second insulation assembly 51*b* for the side walls 17 is secured to the first insulation layer 56. In another embodiment, the air barrier 60 is formed as a continuous sheet—which can include attaching multiple smaller sheets of air barrier 60 material to form the continuous sheet—that is rolled or positioned over the first insulation layer 56 without being attached to either the first or second insulation layer 56, 58. In a further embodiment, the air barrier 60 is secured to the second insulation layer 58. The air barrier 60 can be attached to either the first or second insulation layer 56, 58 by way of lamination, gluing, co-extrusion, or any other manner of fixedly attaching the air barrier 60 to the insulation layer. The air barrier 60 of the second insulation assembly 51*b* for the side walls 17 is formed as a continuous sheet or layer of material, wherein the layer can be a single piece of material or multiple pieces of material secured to each other in order to form the continuous layer.

The first insulation assembly 51*a* for the roof 19, as shown in FIGS. 6A-6B, includes a vapor barrier 54 and a first insulation layer 56. The vapor barrier 54 is formed of a material similar to—or the same as—the vapor barrier 54 of the side walls 17. The vapor barrier 54 of the first insulation assembly 51*a* for the roof 19 is operatively connected to the upper surface of the purlins 30, which can be done by simply laying the vapor barrier over the purlins 30 or by a more secure manner such as a double-sided tape in order to position the vapor barrier 54 on the purlins 30. The first insulation layer 56 is positioned adjacent to the outwardly-directed surface of the vapor barrier 54. The vapor barrier 54 and the first insulation layer 56 are sandwiched between the roof panels 18 and the purlins 30 when the roof panels 18 are installed with the mechanical fasteners 62 (FIG. 6B). The mechanical fasteners 62 are inserted through the roof panels 18, the first layer of insulation 56, the vapor barrier 54, and the purlins 30 to provide a sealed connection between the components to prevent rain or liquid intrusion as well as prevent air or water vapor to escape through the hole created by the mechanical fasteners 62.

During installation, the air barrier 60 of second insulation assembly 51*b* of the side walls 17 is secured to the vapor barrier 54 of the first insulation assembly 51*a* of the roof 19 at the roof-to-wall transition(s), as shown in FIGS. 6A-6B. This connection between the air barrier 60 and the vapor barrier 54 forms a continuous air barrier 60 surrounding the interior of the building that is then attached to the foundation 12 to provide a fully sealed enclosed space 20.

Figure 7B:
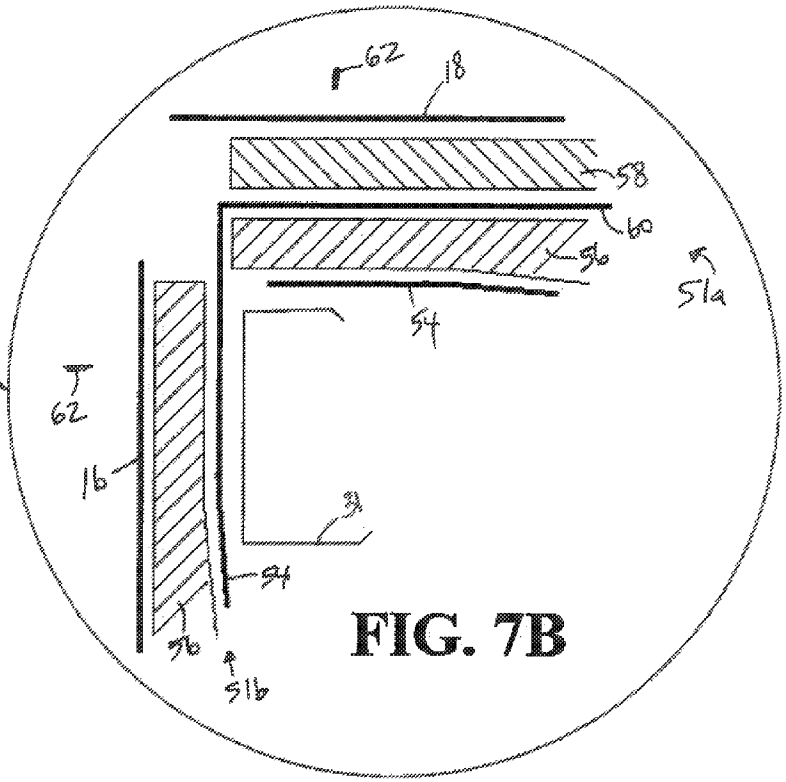
FIG. 7B is an exploded view of the insulation system shown in FIG. 7A.
Figure 7A:
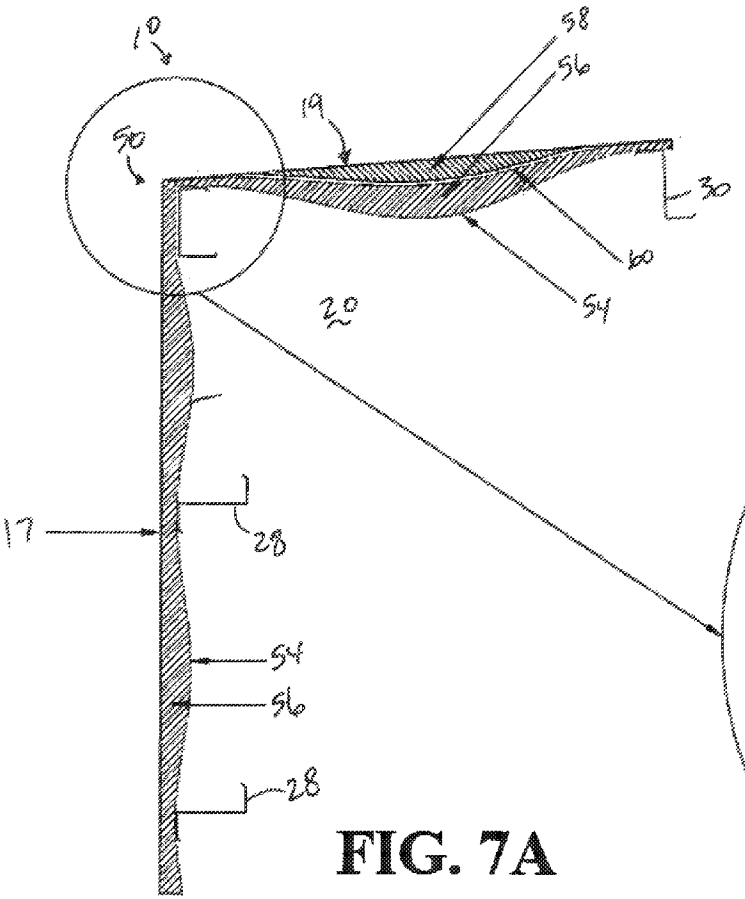
FIG. 7A is a cross-sectional view of another embodiment of a portion of an insulation system.

Yet another embodiment of a pre-engineered metal building 10 is shown in FIGS. 7A-7B in which the insulation system 50 includes a first insulation assembly 51*a* for the roof 19 and a second insulation assembly 51*b* for the side walls 17, wherein the first and second insulation assemblies 51*a*, 51*b* are different. The second insulation assembly 51*b* for the side walls 17 includes a single-layer insulation system, and the first insulation assembly 51*a* for the roof 19 includes a double-layer insulation system using the "sag-and-bag" method. The second insulation assembly 51*b* of the side walls 17 includes a vapor barrier 54 and a first insulation layer 56. In the illustrated embodiment, the vapor barrier 54 is operatively connected to the outwardly-directed surface of the gifts 28. The first insulation layer 56 is positioned adjacent to the outwardly-directed surface of the vapor barrier 54. The side wall facing 16 is positioned outward of the first insulation layer 56 such that the first insulation layer 56 and the vapor barrier 54 are sandwiched between the side wall facing 16 and the girts 28. To satisfy the ASHRAE standard requiring an air barrier, the vapor barrier 54 of the second insulation assembly 51*b* of the side walls 17 is designated as the air barrier for the side walls 17. In this embodiment, the material forming the vapor barrier 54 must meet the permeance requirements of an air barrier in order to be designated as the air barrier in the side walls 17.

The first insulation assembly 51*a* of the roof 19, as shown in FIGS. 7A-7B, includes a vapor barrier 54, a first insulation layer 56, an air barrier 60, and a second insulation layer 58. The vapor barrier 54 is similar to—or the same as—the vapor barrier 54 of the second insulation assembly 51*b* for the side walls 17. The vapor barrier 54 of the first insulation assembly 51*a* for the roof 19 is operatively connected to the purlins 30, wherein the vapor barrier 54 is positioned adjacent to the outer surface of the purlins 30. A first insulation layer 56 is positioned adjacent to the outwardly-directed surface of the vapor barrier 54, wherein the first insulation layer 56 extends across adjacent purlins 30. The air barrier 60 is then positioned adjacent to, and outward of, the first insulation layer 56. The air barrier 60 of the first insulation assembly 51*a* for the roof 19 is designated as the air barrier for the roof portion of the overall insulation system 50. A second insulation layer 58 is positioned adjacent to the outwardly-directed surface of the air barrier 60. The vapor barrier 54, first insulation layer 56, air barrier 60, and the second insulation layer 58 are sandwiched between the roof panels 18 and the purlins 30. The mechanical fasteners 62 are inserted through the roof panels 18, the second insulation layer 58, the air barrier 60, the first insulation layer 56, the vapor barrier 54, and the purlins 30 to provide a sealed connection between the components to prevent rain or liquid intrusion as well as prevent air or water vapor to escape through the hole created by the mechanical fasteners 62. It should be understood by one having ordinary skill in the art that the air barrier 60 of the first insulation assembly 51*a* extends across the top surface of the eave strut 31 and laps around the corner of the eave strut 31 such that the air barrier 60 extends at least partially along the lateral side edge of the eave strut 31.

In an embodiment, the air barrier 60 of the first insulation assembly 51*a* for the roof 19 is secured to the first insulation layer 56. In another embodiment, the air barrier 60 is formed as a continuous sheet—which can include attaching multiple smaller sheets of air barrier 60 material to form the continuous sheet—that is rolled or positioned over the first insulation layer 56 without being attached to either the first or second insulation layer 56, 58. In a further embodiment, the air barrier 60 is secured to the second insulation layer 58. The air barrier 60 can be attached to either the first or second insulation layer 56, 58 by way of lamination, gluing, co-extrusion, or any other manner of fixedly attaching the air barrier 60 to the insulation. The air barrier 60 of the first insulation assembly 51*a* for the roof 19 is formed as a continuous sheet or layer of material, wherein the layer can be a single piece of material or multiple pieces of material secured to each other in order to form the continuous layer.

During installation, the air barrier 60 of the first insulation assembly 51*a* for the roof 19 is secured to the vapor barrier 54 of the second insulation assembly 51*b* for the side walls 17 at the roof-to-wall transition(s), as shown in FIGS. 7A-7B. This connection between the air barrier 60 and the vapor barrier 54 forms a continuous air barrier 60 surrounding the interior of the building that is then attached to the foundation 12 to provide a fully sealed enclosed space 20.

It should be understood by one having ordinary skill in the art that although each of the insulation assemblies explained above with respect to FIGS. 5A-7B having both a vapor barrier and an air barrier also included first and second insulation layers 56, 58, these insulation assemblies may alternatively include a vapor barrier 54, first insulation layer 56, and an air barrier 60 without a second insulation layer 58.

Figure 8B:
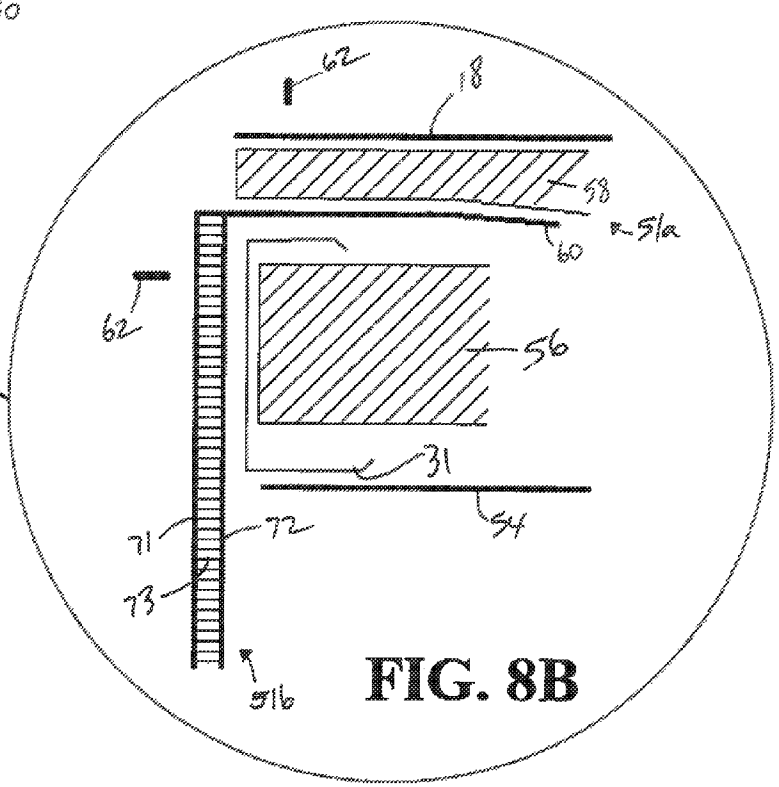
FIG. 8B is an exploded view of the insulation system shown in FIG. 8A.
Figure 8A:
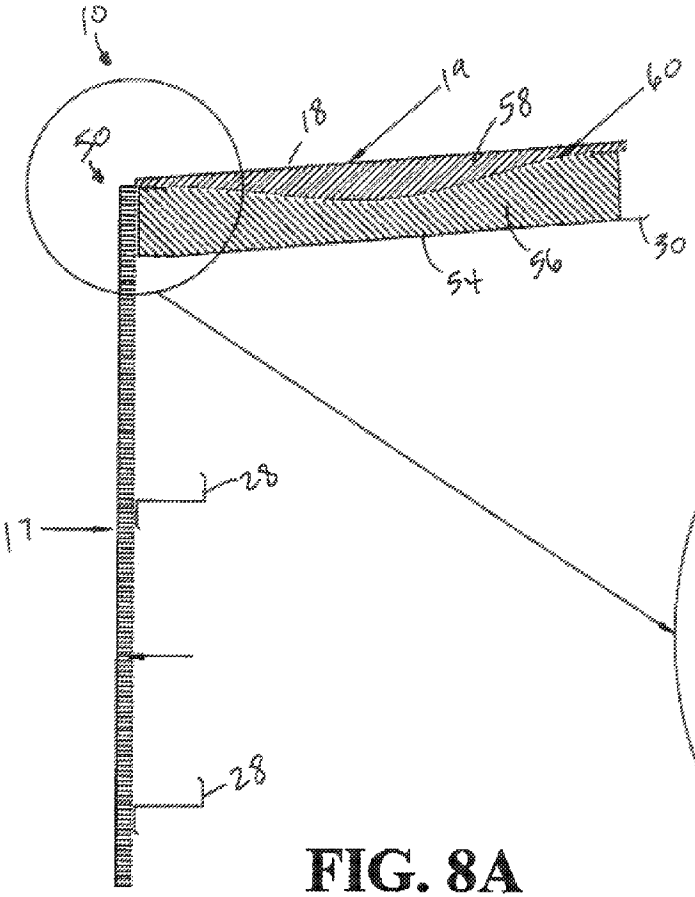
FIG. 8A is a cross-sectional view of yet another embodiment of a portion of an insulation system.

As shown in FIGS. 8A-8B, another embodiment of a pre-engineered metal building 10 includes an insulation system 50 having a first insulation assembly 51*a* for the roof 19 and a second insulation assembly 51*b* for the side walls 17, wherein the first insulation assembly 51*a* is different than the second insulation assembly 51*b*. The first insulation assembly 51*a* includes a vapor barrier 54, a first insulation layer 56, an air barrier 60, and a second insulation layer 58, wherein at least a portion of the first insulation assembly 51*a* is positioned between panels of roof sheeting 18 and the purlins 30. The vapor barrier 54 is positioned adjacent to the inwardly-directed surface of the purlins. In the illustrated embodiment, the first insulation layer 54 is positioned adjacent to the outwardly-directed surface of the vapor barrier 54 and is oriented generally parallel to the purlins 30. The first insulation layer 54 is positioned between adjacent purlins 30. The air barrier 60 is positioned adjacent to the first insulation layer 54 and is positioned adjacent to the outwardly-directed surface of the purlins 30. The air barrier 60 of the first insulation assembly 51*a* for the roof 19 is designated as the air barrier for the roof portion of the overall insulation system 50. The air barrier 60 of the first insulation assembly 51*a* for the roof 19 is formed as a continuous sheet or layer of material, wherein the layer can be a single piece of material or multiple pieces of material secured to each other in order to form the continuous layer. The air barrier 60 and the second insulation layer 58 are sandwiched between the roof panels 18 and the purlins 30 when the roof panels 18 are installed with the mechanical fasteners 62 (FIG. 8B). The mechanical fasteners 62 are inserted through the roof panels 18, the second insulation layer 58, the air barrier 60, and the purlins 30 to provide a sealed connection between the components. It should be understood by one having ordinary skill in the art that the air barrier 60 of the first insulation assembly 51*a* extends across the top surface of the eave strut 31 and laps around the corner of the eave strut 31 such that the air barrier 60 extends at least partially along the lateral side edge of the eave strut 31.

The second insulation assembly 51*b* for the side walls 17, as shown in FIGS. 8A-8B, is formed as a plurality of rigid panel members 70 sealingly connected to each other to form continuous side walls 17 between the foundation 12 and the roof 19. In the illustrated embodiment, the rigid panel members 70 of the second insulation assembly 51*b* are formed as insulated wall panels. The insulated wall panels 70 are typically designed specifically for each building and the performance desired therefor. In an exemplary embodiment, the rigid panel member 70 includes an exterior vapor barrier 71, an interior vapor barrier 72, and a first insulation layer 73 therebetween. The exterior vapor barrier 71 and the interior vapor barrier 72 of the insulated wall panel 70 are both formed as finished metal layers. The first insulation layer 73 is formed as a foam core. The exterior and interior vapor barriers 71, 72 are fixedly attached to the first insulation layer 73 to form the rigid panel member 70. An exemplary manner of manufacturing an insulated wall panel 70 includes injecting the foam core into the gap provided when the exterior and interior finished metal surface are spaced apart. As the insulated wall panels 70 are installed, the joints of adjacent insulated wall panels 70 are sealed together so as to form a continuous side wall 17 that extends about the entire vertical surface(s) of the building. The entire insulated wall panel 70 is designated as the air barrier for the side walls 17 so as to meet the ASHRAE standard. Alternatively, the interior vapor barrier 72 may also be designated as the air barrier for the side walls 17, particularly because the interior vapor barrier 72 that is formed as a finished metal surface can satisfy the air permeance requirements for an air barrier. The insulated wall panel 70 includes an exterior vapor barrier 71 formed as a finished metal layer, which eliminates the need for panels of side wall facing 16 to be attached. It should be understood by one having ordinary skill in the art that the side walls 17 can include side wall facing 16 attached outward of the insulated wall panel 70, or the exterior finished metal layer 71 can be used as the outward-most surface of the side walls 17.

During installation, the air barrier 60 of the first insulation assembly 51*a* for the roof 19 is secured to the exterior vapor barrier 71 of the second insulation assembly 51*b* for the side walls 17 at the roof-to-wall transition(s), as shown in FIGS. 8A-8B. In the illustrated embodiment, the air barrier 60 of the first insulation assembly 51*a* for the roof 19 is secured to the interior vapor barrier 72 of the second insulation assembly 51*b* for the side walls 17 at the roof-to-wall transition(s). In both embodiments, the exterior and interior vapor barriers 71, 72 can be designated as air barriers, or the entire insulated wall panel 70 can be designated as the air barrier, which allows for a continuous air barrier along the entire side walls 17. The connection between the air barrier 60 and the insulated wall panels 70 forms a continuous air barrier 60 surrounding the interior of the building, and the insulated wall panels 70 are then attached to the foundation 12 to provide a fully sealed enclosed space 20.

Figure 9B:
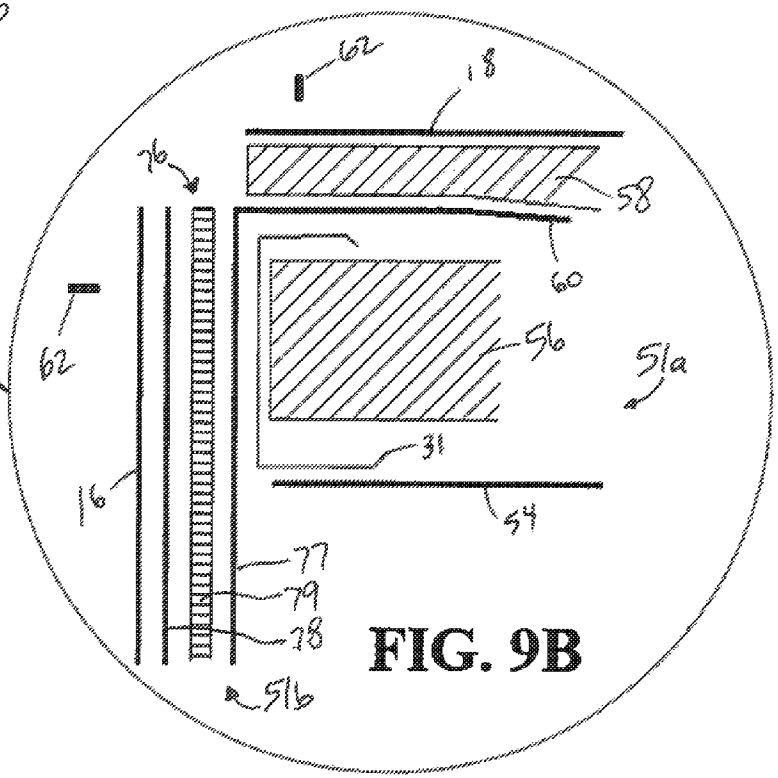
FIG. 9B is an exploded view of the insulation system shown in FIG. 9A.
Figure 9A:
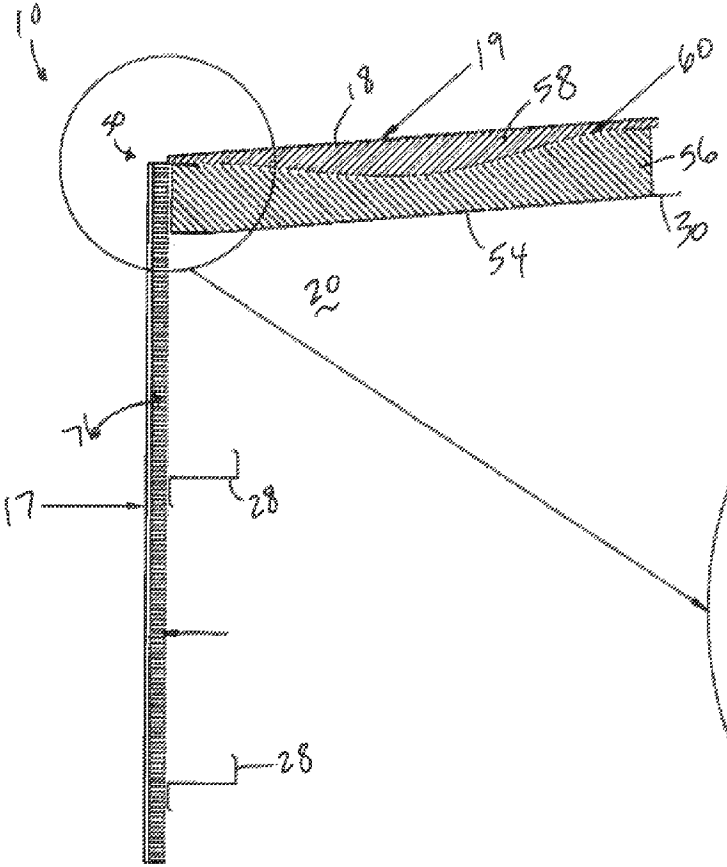
FIG. 9A is a cross-sectional view of a further embodiment of a portion of an insulation system.

As shown in FIGS. 9A-9B, yet another embodiment of a pre-engineered metal building 10 includes an insulation system 50 having a first insulation assembly 51*a* for the roof 19 and a second insulation assembly 51*b* for the side walls 17, wherein the first insulation assembly 51*a* is different than the second insulation assembly 51*b*. The first insulation assembly 51*a* includes a vapor barrier 54, a first insulation layer 56, an air barrier 60, and a second insulation layer 58, wherein at least a portion of the first insulation assembly 51*a* is positioned between panels of roof sheeting 18 and the purlins 30. The vapor barrier 54 is positioned adjacent to the inwardly-directed surface of the purlins. In the illustrated embodiment, the first insulation layer 56 is positioned adjacent to the outwardly-directed surface of the vapor barrier 54 and is oriented generally parallel to the purlins 30. The first insulation layer 54 is positioned between adjacent purlins 30. The air barrier 60 is positioned adjacent to the first insulation layer 54 and is positioned adjacent to the outwardly-directed surface of the purlins 30. The air barrier 60 of the first insulation assembly 51*a* for the roof 19 is designated as the air barrier for the roof portion of the overall insulation system 50. The air barrier 60 of the first insulation assembly 51*a* for the roof 19 is formed as a continuous sheet or layer of material, wherein the layer can be a single piece of material or multiple pieces of material secured to each other in order to form the continuous layer. The air barrier 60 and the second insulation layer 58 are sandwiched between the roof panels 18 and the purlins 30 when the roof panels 18 are installed with the mechanical fasteners 62 (FIG. 9B). The mechanical fasteners 62 are inserted through the roof panels 18, the second insulation layer 58, the air barrier 60, and the purlins 30 to provide a sealed connection between the components. It should be understood by one having ordinary skill in the art that the air barrier 60 of the first insulation assembly 51*a* extends across the top surface of the eave strut 31 and laps around the corner of the eave strut 31 such that the air barrier 60 extends at least partially along the lateral side edge of the eave strut 31.

The second insulation assembly 51*b* for the side walls 17, as shown in FIGS. 8A-8B, is formed as a plurality of rigid panel members 76 sealingly connected to each other to form continuous side walls 17 between the foundation 12 and the roof 19. In an exemplary embodiment, the rigid panel members 76 are formed as board insulation. Each rigid panel member 76 includes an interior vapor barrier 77, an exterior vapor barrier 78, and a first insulation layer 79 formed of an rigid board insulation material positioned between the interior and exterior vapor barriers 77, 78. In an embodiment, the interior and exterior vapor barriers 77, 78 are fixedly attached to the first insulation layer 79 positioned therebetween. In an embodiment, the first insulation layer 79 of the rigid panel member 76 is formed as polyisocyanurate foam, but it should be understood by one having ordinary skill in the art that other rigid board insulation materials may be used to form the first insulation layer 70 of the rigid panel member 76. As the panels of rigid panel member 76 are installed, the joints of adjacent interior and external vapor barriers 77, 78 are sealed together so as to form a continuous side wall 17 that extends about the entire vertical surface(s) of the building. In an embodiment, the entire assembly of the rigid panel member 76 is designated as the air barrier. In other embodiments, the interior vapor barrier 77 is designated as the air barrier for the rigid panel member 76. Panels of side wall facing 16 are positioned adjacent to, and outward of, the exterior vapor barrier 78 of the rigid panel member 76. Mechanical fasteners 62 are used to attach the panels of side wall facing 16 and the rigid panel members 76 to the girts 28 in a sandwiching manner.

During installation, the air barrier 60 of the first insulation assembly 51*a* for the roof 19 is secured to the interior vapor barrier 77 of the second insulation assembly 51*b* for the side walls 17 at the roof-to-wall transition(s), as shown in FIGS. 9A-9B. This connection between the air barrier 60 and the interior vapor barrier 77 of the rigid panel members 76 forms a continuous air barrier 60 surrounding the interior of the building, and the rigid panel members 76 are then attached to the foundation 12 to provide a fully sealed enclosed space 20.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. An insulation system for a pre-engineered metal building, said pre-engineered metal building including a foundation and a structural frame attached thereto, said structural frame including a plurality of joined side walls having a plurality of girts and a roof having a plurality of purlins, said insulation system comprising:

a first insulation assembly for either said roof or said side walls, said first insulation assembly includes a vapor barrier, a first insulation layer, and an air barrier, wherein at least a portion of said first insulation assembly is positioned between a plurality of panels of roof sheeting and a plurality of roof purlins or between a plurality of panels of side wall facing and a plurality of wall girts;

a second insulation assembly for the other of said roof or said side walls, said second insulation assembly includes a vapor barrier and a first insulation layer, said vapor barrier being configured to also act as an air barrier;

wherein said air barrier of said first insulation assembly is sealingly attached to said vapor barrier of said second insulation assembly to form a continuous air barrier, said continuous air barrier being attached to said foundation to form a fully sealed enclosed space therewithin.

2. The insulation system for a pre-engineered metal building of claim 1, wherein at least a portion of said second insulation assembly is positioned between the other of said plurality of panels of roof sheeting and said plurality of roof purlins or between said plurality of panels of side wall facing and said plurality of wall girts than said first insulation assembly.

3. The insulation system for a pre-engineered metal building of claim 1, wherein said first insulation assembly further includes a second insulation layer positioned outward of said air barrier.

4. The insulation system for a pre-engineered metal building of claim 3, wherein said first insulation layer of said first insulation assembly is positioned between adjacent purlins and said second insulation layer of said first insulation assembly is positioned between panels of roof sheeting and said purlins.

5. The insulation system for a pre-engineered metal building of claim 3, wherein said first and second insulation layers of said first insulation assembly are positioned between panels of roof sheeting and said purlins.

6. The insulation system for a pre-engineered metal building of claim 3, wherein said first insulation layer of said first insulation assembly is positioned between adjacent girts and said second insulation layer of said first insulation assembly is positioned between panels of side wall facing and said girts.

7. The insulation system for a pre-engineered metal building of claim 1, wherein said second insulation assembly is formed as a plurality of rigid panel members sealingly connected to each other.

8. The insulation system for a pre-engineered metal building of claim 7, wherein each of said rigid panel members of said second insulation assembly includes said vapor barrier, said first insulation layer, and a second vapor barrier, said vapor barrier being sealingly connected to said air barrier of said first insulation layer.

9. The insulation system for a pre-engineered metal building of claim 8, wherein said vapor barrier is formed as a finished metal layer and said first insulation layer is formed as a foam core.

10. The insulation system for a pre-engineered metal building of claim 7, wherein said second insulation assembly is formed as board insulation having said vapor barrier, said first insulation layer, and a second vapor barrier, said vapor barriers being fixedly attached to said first insulation layer.

11. The insulation system for a pre-engineered metal building of claim 10, wherein said first insulation layer is formed of polyisocyanurate foam.

12. An insulation system for a pre-engineered metal building, said pre-engineered metal building including a foundation and a structural frame attached thereto, said structural frame including a plurality of joined side walls having a plurality of girts and a roof having a plurality of purlins, said insulation system comprising:

a first insulation assembly for either said roof or said side walls, said first insulation assembly includes a vapor barrier, a first insulation layer, a second insulation layer, and an air barrier, wherein said air barrier is positioned between said first and second insulation layers, wherein at least a portion of said first insulation assembly is positioned between a plurality of panels of roof sheeting and a plurality of roof purlins or between a plurality of panels of side wall facing and a plurality of wall girts;

a second insulation assembly for the other of said roof or said side walls, said second insulation assembly includes a vapor barrier and a first insulation layer, said vapor barrier configured to also act as an air barrier;

wherein said air barrier of said first insulation assembly is sealingly attached to said vapor barrier of said second insulation assembly to form a continuous air barrier, said continuous air barrier being attached to said foundation to form a fully sealed enclosed space therewithin.

13. An insulation system for a pre-engineered metal building, said pre-engineered metal building including a foundation and a structural frame attached thereto, said structural frame including a plurality of joined side walls having a plurality of girts and a roof having a plurality of purlins, said insulation system comprising:

a first insulation assembly for said roof, said first insulation assembly includes a vapor barrier, a first insulation layer, and an air barrier, wherein at least a portion of said first insulation assembly is positioned between a plurality of panels of roof sheeting and a plurality of roof purlins or between a plurality of panels of side wall facing and a plurality of wall girts;

a second insulation assembly for said side walls, said second insulation assembly is formed as a plurality of rigid panel members, wherein each rigid panel member includes a pair of opposing metal layers attached to an insulation layer therebetween, said plurality of rigid panel members sealingly attached to each other to form continuous side walls, wherein one of said metal layers of said rigid panel members is configured to also act as an air barrier;

wherein said air barrier of said first insulation assembly is sealingly attached to said said metal layer also acting as said air barrier of said second insulation assembly to form a continuous air barrier, said rigid panel members of said second insulation assembly being attached to said foundation to form a fully sealed enclosed space therewithin.

* * * * *